US010563357B2

(12) United States Patent
Ueda et al.

(10) Patent No.: US 10,563,357 B2
(45) Date of Patent: Feb. 18, 2020

(54) RAIL AND PRODUCTION METHOD THEREFOR

(71) Applicant: NIPPON STEEL & SUMITOMO METAL CORPORATION, Tokyo (JP)

(72) Inventors: Masaharu Ueda, Kitakyushu (JP); Teruhisa Miyazaki, Kitakyushu (JP); Takuya Tanahashi, Kitakyushu (JP)

(73) Assignee: NIPPON STEEL CORPORATION, Tokyo (JP)

( * ) Notice: Subject to any disclaimer, the term of this patent is extended or adjusted under 35 U.S.C. 154(b) by 513 days.

(21) Appl. No.: 15/307,544

(22) PCT Filed: May 29, 2015

(86) PCT No.: PCT/JP2015/065621
§ 371 (c)(1),
(2) Date: Oct. 28, 2016

(87) PCT Pub. No.: WO2015/182759
PCT Pub. Date: Dec. 3, 2015

(65) Prior Publication Data

US 2017/0051373 A1 Feb. 23, 2017

(30) Foreign Application Priority Data

May 29, 2014 (JP) ..... 2014-111735

(51) Int. Cl.
*E01B 5/02* (2006.01)
*C21D 9/04* (2006.01)
(Continued)

(52) U.S. Cl.
CPC ..... *E01B 5/02* (2013.01); *C21D 1/06* (2013.01); *C21D 8/005* (2013.01); *C21D 9/04* (2013.01);
(Continued)

(58) Field of Classification Search
CPC .. E01B 5/08; C21D 1/06; C21D 8/005; C21D 9/04; C21D 2211/002; C21D 2211/009;
(Continued)

(56) References Cited

U.S. PATENT DOCUMENTS 5,209,792 A * 5/1993 Besch ..... C21D 9/04 148/320
5,382,307 A * 1/1995 Kageyama ..... C21D 1/20 148/320
(Continued)

FOREIGN PATENT DOCUMENTS

JP 8-92645 A 4/1996
JP 8-92696 A 4/1996
(Continued)

OTHER PUBLICATIONS

International Search Report for PCT/JP2015/065621 dated Aug. 18, 2015.
(Continued)

*Primary Examiner* — Zachary L Kuhfuss
(74) *Attorney, Agent, or Firm* — Birch, Stewart, Kolasch & Birch, LLP

(57) ABSTRACT

A rail provided by the present invention includes: has a predetermined chemical components, wherein, in a region from a head surface constituted of a surface of a top head portion and a surface of a corner head portion to a depth of 10 mm, a total amount of pearlite structures and bainite structures is 95% by area or more, and an amount of the bainite structures is 20% by area or more and less than 50% by area, and an average hardness of the region from the head surface to a depth of 10 mm is in a range of Hv 400 to Hv 500.

6 Claims, 6 Drawing Sheets

(51) Int. Cl.

| | |
|---|---|
| ***C21D 1/06*** | (2006.01) |
| ***C21D 8/00*** | (2006.01) |
| ***C22C 38/00*** | (2006.01) |
| ***C22C 38/02*** | (2006.01) |
| ***C22C 38/04*** | (2006.01) |
| ***C22C 38/18*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/30*** | (2006.01) |
| ***C22C 38/32*** | (2006.01) |
| ***C22C 38/40*** | (2006.01) |

(52) U.S. Cl.
CPC ..... *C22C 38/002* (2013.01); *C22C 38/02* (2013.01); *C22C 38/04* (2013.01); *C22C 38/18* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/40* (2013.01); *C21D 2211/002* (2013.01); *C21D 2211/009* (2013.01)

(58) Field of Classification Search
CPC ..... C22C 38/00; C22C 38/002; C22C 38/02; C22C 38/04; C22C 38/06
USPC ..... 238/150
See application file for complete search history.

(56) References Cited

U.S. PATENT DOCUMENTS

| | | | | |
|---|---|---|---|---|
| 5,645,653 | A * | 7/1997 | Jerath | C21D 9/04 148/320 |
| 5,759,299 | A * | 6/1998 | Yokoyama | C21D 9/04 148/333 |
| 7,288,159 | B2 * | 10/2007 | Cordova | C21D 9/04 148/320 |
| 8,821,652 | B2 * | 9/2014 | Kozawa | C21D 1/10 148/320 |
| 9,127,409 | B2 * | 9/2015 | Ueda | C21D 9/04 |
| 9,534,278 | B2 * | 1/2017 | Ueda | C21D 9/04 |
| 10,233,512 | B2 * | 3/2019 | Ueda | C21D 9/04 |
| 2010/0186857 | A1 * | 7/2010 | Honjo | C21D 1/02 148/584 |
| 2011/0155821 | A1 * | 6/2011 | Ueda | C21C 7/0025 238/150 |
| 2011/0226389 | A1 * | 9/2011 | Ueda | C21D 9/04 148/330 |
| 2011/0303756 | A1 * | 12/2011 | Ueda | C21D 9/04 238/150 |
| 2015/0069141 | A1 | 3/2015 | Ueda et al. | |
| 2015/0136864 | A1 | 5/2015 | Ueda et al. | |
| 2017/0044634 | A1 * | 2/2017 | Ueda | C21D 9/04 |
| 2017/0051373 | A1 * | 2/2017 | Ueda | C21D 8/00 |

FOREIGN PATENT DOCUMENTS

| | | | |
|---|---|---|---|
| JP | 10-280098 | A | 10/1998 |
| JP | 3114490 | B2 | 12/2000 |
| JP | 3253852 | B2 | 2/2002 |
| JP | 3267124 | B2 | 3/2002 |
| JP | 2002-363698 | A | 12/2002 |
| JP | 2010-77481 | A | 4/2010 |
| JP | 2013-224471 | A | 10/2013 |
| JP | 5459453 | B1 | 4/2014 |
| JP | 5482974 | B1 | 5/2014 |
| WO | WO 2014/049032 | A1 | 4/2014 |

OTHER PUBLICATIONS

Written Opinion of the International Searching Authority for PCT/JP2015/065621 (PCT/ISA/237) dated Aug. 18, 2015.

* cited by examiner

RAIL AND PRODUCTION METHOD THEREFOR

TECHNICAL FIELD OF THE INVENTION

The present invention relates to a rail and a production method therefor and, particularly, relates to a rail for curved sections intended to improve wear resistance and surface damage resistance which are required when the rail is used for freight railways and a production method therefor.

Priority is claimed on Japanese Patent Application No. 2014-111735, filed on May 29, 2014, the content of which is incorporated herein by reference.

RELATED ART

In accordance with economic advancement, new developments of natural resources such as coal are underway. Specifically, mining of natural resources in districts with harsh natural environments which have not yet been developed is underway. Accordingly, environments in which rails for freight railways for transporting mined natural resources are used have become significantly harsh. Particularly, for rails used for freight railways, there has been a demand for surface damage resistance that is stronger than ever. The surface damage resistance of rails refers to a characteristic indicating resistance to the generation of damage on rail surfaces (particularly, the surfaces of rail head portions which are contact sections between rails and wheels).

In order to improve the surface damage resistance of steel used for rails (hereinafter, also referred to as rail steel), in the related art, rails having bainite structures as described below have been developed. A major characteristic of these rails of the related art is that bainite structures are provided as the main structure of the rails by means of the control of chemical components and a heat treatment and wear of rail head portions which are contact sections between rails and wheels is accelerated. Since wear of rail head portions eliminate damage generated on rail head portions, the acceleration of wear improves the surface damage resistance of rail head portions.

Patent Document 1 discloses a rail which is obtained by accelerated-cooling steel, of which the amount of carbon (C: 0.15% to 0.45%) is relatively small in the technical field of rail steel, from an austenite range temperature at a cooling rate of 5° C./sec to 20° C./sec and forming bainite structures as a structure thereof and has improved surface damage resistance.

Patent Document 2 discloses a rail having improved surface damage resistance which is obtained by forming bainite structures in steel, of which the amount of carbon (C: 0.15% to 0.55%) is relatively small in the technical field of rail steel, and furthermore, on which an alloy design for controlling the intrinsic resistance value of rails is carried out.

As described above, in the techniques disclosed by Patent Documents 1 and 2, bainite structures are formed in rail steel, and wear of rail head portions is accelerated, thereby improving the surface damage resistance to a certain extent. However, in freight railways, recently, railway transportation has become busier, and wear of rail head portions has been accelerated, and thus there has been a demand for additional improvement in the service life of rails by means of improvement in wear resistance. The wear resistance of rails refers to a characteristic indicating resistance to the occurrence of wear.

Therefore, there has been a demand for the development of rails improved in terms of both surface damage resistance and wear resistance. In order to solve this problem, in the related art, high-strength rails having bainite structures as described below have been developed. In these rails of the related art, in order to improve wear resistance, alloys of Mn, Cr, and the like are added, the transformation temperature of bainite is controlled, and the hardness is improved (for example, see Patent Documents 3 and 4).

Patent Document 3 discloses a technique for increasing the amounts of Mn and Cr and controlling the hardness of rail steel to be Hv 330 or higher in steel of which the amount of carbon (C: 0.15% to 0.45%) is relatively small in the technical field of rail steel.

Patent Document 4 discloses a technique for increasing the amounts of Mn and Cr, furthermore, adding Nb, and controlling the hardness of rail steel to be Hv 400 to Hv 500 in steel of which the amount of carbon (C: 0.15% to 0.50%) is relatively small in the technical field of rail steel.

As described above, in the techniques of Patent Documents 3 and 4, wear resistance is improved to a certain extent by increasing the hardness of rail steel. However, in freight railways having a high contact surface pressure, wear of rail head portions is accelerated, and thus, in recent years, there has been an object of additional improvement in the service life of rails which enables rails to withstand further congestion of railway transportation.

Therefore, there has been a demand for the development of new high-strength rails improved in terms of surface damage resistance and wear resistance which are required for rails for freight railways.

Patent Document 5 discloses a technique for improving wear resistance by mixing pearlite structures having strong wear resistance into bainite structures in steel of which the amount of carbon (C: 0.25% to 0.60%) is relatively small in the technical field of rail steel in order to improve the wear resistance of bainite structures.

As described above, in the technique disclosed by Patent Document 5, wear resistance is improved to a certain extent by mixing pearlite structures into bainite structures. However, major structures obtained using the technique disclosed by Patent Document 5 are bainite structures, and thus the technique disclosed by Patent Document 5 is not capable of sufficiently improving wear resistance.

PRIOR ART DOCUMENT

Patent Document

[Patent Document 1] Japanese Patent No. 3253852

[Patent Document 2] Japanese Patent No. 3114490

[Patent Document 3] Japanese Unexamined Patent Application, First Publication No. H8-92696

[Patent Document 4] Japanese Patent No. 3267124

[Patent Document 5] Japanese Unexamined Patent Application, First Publication No. 2002-363698

DISCLOSURE OF THE INVENTION

Problems to be Solved by the Invention

The present invention has been made in consideration of the above-described problems, and an object thereof is to provide a rail improved in terms of both wear resistance and surface damage resistance which are required particularly for rails used in curved sections for freight railways and a production method therefor.

Means for Solving the Problem

In order to achieve the above-described object, the present inventors carried out intensive studies regarding chemical components, structures, and the like which enable the obtainment of rails having excellent wear resistance and surface damage resistance and completed the present invention.

The gist of the present invention is as follows.

(1) A rail according to an aspect of the present invention includes: a rail head portion having a top head portion which is a flat region extending toward a top portion of the rail head portion in a extending direction of the rail, a side head portion which is a flat region extending toward a side portion of the rail head portion in the extending direction of the rail, and a corner head portion which is a region combining a rounded corner portion extending between the top head portion and the side head portion and an upper half of the side head portion, wherein the rail contains as a chemical components, in terms of mass %: C: 0.70% to 1.00%, Si: 0.20% to 1.50%, Mn: 0.20% to 1.00%, Cr: 0.40% to 1.20%, P: 0.0250% or less, S: 0.0250% or less, Mo: 0% to 0.50%, Co: 0% to 1.00%, Cu: 0% to 1.00%, Ni: 0% to 1.00%, V: 0% to 0.300%, Nb: 0% to 0.0500%, Mg: 0% to 0.0200%, Ca: 0% to 0.0200%, REM: 0% to 0.0500%, B: 0% to 0.0050%, Zr: 0% to 0.0200%, and N: 0% to 0.0200%, and a remainder of Fe and impurities, wherein, in a region from a head surface constituted of a surface of the top head portion and a surface of the corner head portion to a depth of 10 mm, a total amount of pearlite structures and bainite structures is 95% by area or more, and an amount of the bainite structures is 20% by area or more and less than 50% by area, and wherein an average hardness of the region from the head surface to a depth of 10 mm is in a range of Hv 400 to Hv 500.

(2) The rail according to (1) may contain as the chemical components, in terms of mass %, one or more selected from the group consisting of: Mo: 0.01% to 0.50%, Co: 0.01% to 1.00%, Cu: 0.05% to 1.00%, Ni: 0.05% to 1.00%, V: 0.005% to 0.300%, Nb: 0.0010% to 0.0500%, Mg: 0.0005% to 0.0200%, Ca: 0.0005% to 0.0200%, REM: 0.0005% to 0.0500%, B: 0.0001% to 0.0050%, Zr: 0.0001% to 0.0200%, and N: 0.0060% to 0.0200%.

(3) A production method for a rail according to another aspect of the present invention includes: hot-rolling a bloom or slab containing the chemical components according to (1) or (2) in a rail shape to obtain a material rail, 1 st-accelerated-cooling the head surface of the material rail from a temperature region of 700° C. or higher which is a temperature region that is equal to or higher than a transformation start temperature from austenite to a temperature region of 600° C. to 650° C. at a cooling rate of 3.0° C./sec to 10.0° C./sec after the hot-rolling, holding a temperature of the head surface of the material rail in the temperature region of 600° C. to 650° C. for 10 sec to 300 sec after the 1 st-accelerated-cooling, further, 2nd-accelerated-cooling the head surface of the material rail from the temperature region of 600° C. to 650° C. to a temperature region of 350° C. to 500° C. at a cooling rate of 3.0° C./sec to 10.0° C./sec after the holding, and naturally-cooling the head surface of the material rail to room temperature after the 2nd-accelerated-cooling.

(4) The production method for a rail according to (3), may further include: preliminarily-cooling the hot-rolled rail and then reheating the head surface of the material rail to an austenite transformation completion temperature+30° C. or higher between the hot-rolling and the 1st-accelerated-cooling.

Effects of the Invention

According to the present invention, the wear resistance and the surface damage resistance of rails used in curved sections for freight railways are improved by controlling the chemical components of rail steel, the total area ratio of pearlite and bainite, and the area ratio of bainite and, furthermore, controlling the hardness of rail head portions, whereby it becomes possible to significantly improve the service life of rails.

EMBODIMENTS OF THE INVENTION

Figure 1:
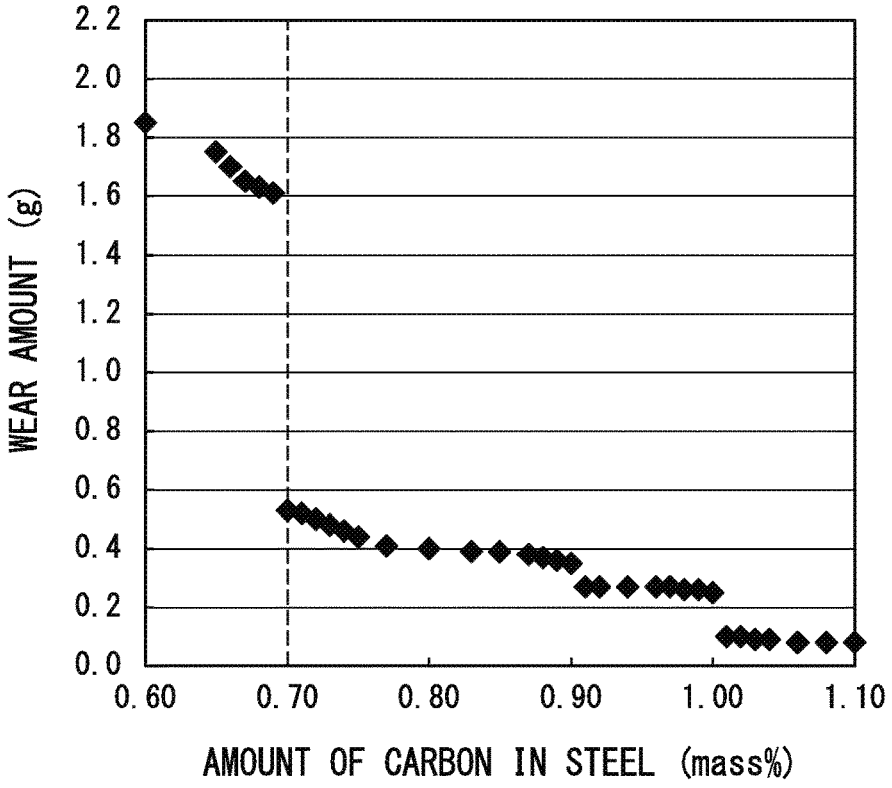
FIG. 1 is a graph showing a relationship between an amount of carbon in steel and a wear amount in test rails (test steel group A).

Hereinafter, a rail having excellent wear resistance and excellent surface damage resistance will be described in detail as an embodiment of the present invention.

Hereinafter, the unit "mass %" of the amounts of chemical components will be simply denoted as "%".

First, the present inventors studied relationships between the wear and surface damage of rail head portions, which occur due to the repetitive contact between rails and wheels, and the metallographic structures of rail head portions. As a result, it was found that an amount of work hardening on rolling contact surfaces of pearlite structures having a lamellar structure of ferrite and cementite is large, and thus the pearlite structures significantly improves wear resistance of rail head portions. In addition, it was clarified that an amount of work hardening on rolling contact surfaces of bainite structures having a structure in which hard granular carbides are dispersed in a soft ferrite structure is smaller than that of pearlite structures, and thus bainite structures accelerates wear, consequently, bainite structures suppresses the generation of rolling contact fatigue damage, and improves the surface damage resistance of rail head portions. Furthermore, the present inventors found that, in order to improve both of the wear resistance and surface damage resistance of rails, it is effective to mainly form mixed structures of pearlite structures and bainite structures (hereinafter, in some cases, simply referred to as the mixed structures) as the structure of the head surface portions of rails, and structures such as pro-eutectoid ferrite and martensite damage the wear resistance and surface damage resistance of the rail according to the present embodiment.

Additionally, the present inventors carried out the following studies in order to realize additional optimization of the mixed structures of the head surface portions of rails. Meanwhile, all of the test steel groups used in the following studies, the amount of structures other than pearlite structures and bainite structures (pro-eutectoid ferrite, martensite, and the like) was less than 5.0% by area.

(1. Relationship Between Amount of Carbon and Wear Resistance in Steel having Pearlite-Bainite Mixed Structures)

First, in order to improve the wear resistance of mixed structures of pearlite steel and bainite steel, the present inventors produced a variety of steel ingots in which the structures of the head surface portions are mixed structures of pearlite structures and bainite structures and the amounts of carbon in steel are different from each other in a laboratory, and hot rolled the steel ingots, thereby producing material rails. Furthermore, the present inventors carried out a heat treatment on the head surface portions of the material rails, produced test rails (test steel group A), and carried out a variety of evaluations. Specifically, the hardness and structures of the head surface portions of the test rails were measured, and two-cylinder wear tests were carried out on cylindarical test specimens cut out from the head surface portions of the test rails, thereby evaluating the wear resistance of the test rails. Meanwhile, the chemical components, structures, heat treatment conditions, and wear test conditions of test steel group A are as described below.

<Chemical Components of Test Steel Group A>

C: 0.60% to 1.10%;

Si: 0.50%;

Mn: 0.60%

Cr: 1.00%;

P: 0.0150%;

S: 0.0120%; and a remainder: Fe and impurities

The following heat treatment was carried out on steel having the above-described chemical components, thereby producing test steel group A (rails).

<Heat Treatment Conditions of Test Steel Group A>

Heating temperature: 950° C. (temperature of austenite transformation completion temperature+30° C. or higher)

Holding time at the above-described heating temperature: 30 min

Cooling conditions: After the above-described holding time elapsed, the rails were acceleratively-cooled to 620° C. at a cooling rate of 5.0° C./sec, were held at 620° C. for 10 sec to 300 sec, furthermore, were acceleratively-cooled to 400° C. at 5.0° C./sec, and were naturally-cooled to room temperature.

<Structure Observation Method for Test Steel Group A>

Pretreatment: Cross sections perpendicular to the rolling direction were diamond-polished, and then were etched using 3% Nital.

Structure observation: An optical microscope was used.

Measurement method of pearlite area ratios and bainite area ratios: The pearlite area ratios and the bainite area ratios at 20 places at depth of 2 mm from the head surfaces of the test rails and the pearlite area ratios and the bainite area ratios at 20 places at depth of 10 mm from the head surfaces were obtained on the basis of optical microscopic photographs, and the area ratios were averaged, thereby obtaining the pearlite area ratios and the bainite area ratios.

<Hardness Measurement Method for Test Steel Group A>

Pretreatment: Cross sections were diamond-polished.

Device: A Vickers hardness tester was used (the load was 98 N).

Measurement method: Measured according to JIS Z 2244.

Measurement method of hardness: Hardness at 20 places at depth of 2 mm from the head surfaces of the test rails and hardness at 20 places at depth of 10 mm from the head surfaces were obtained, and the hardness values were averaged, thereby obtaining the hardness.

<Structure and Hardness of Test Steel Group A>

Overall structure of cylindarical test specimen: 60% by area of pearlite structures and 40% by area of bainite structures were included.

Hardness of test surfaces (outer circumferential portions) of cylindarical test specimens: Hv 420 to Hv 440

Meanwhile, the above-described "austenite transformation completion temperature" refers to a temperature at which, in a process of heating steel from a temperature region of 700° C. or lower, transformation from ferrite and/or cementite to austenite is completed. The austenite transformation completion temperature of hypo-eutectoid steel is an $Ac_3$ point (a temperature at which transformation from ferrite to austenite is completed), the austenite transformation completion temperature of hyper-eutectoid steel is an $Ac_{cm}$ point (a temperature at which transformation from cementite to austenite is completed), and the austenite transformation completion temperature of eutectoid steel is an $Ac_1$ point (a temperature at which transformation from ferrite and cementite to austenite is completed). The austenite transformation completion temperature varies depending on the amount of carbon and the chemical components of steel. In order to accurately obtain the austenite transformation completion temperature, verification by means of tests is required. However, in order to simply obtain the austenite transformation completion temperature, the austenite transformation completion temperature may be obtained from the Fe—$Fe_3C$-based equilibrium diagram described in metallurgy textbooks (for example, "Iron and Steel Materials", The Japan Institute of Metals and Materials) on the basis of the amount of carbon alone. Meanwhile, within the ranges of the chemical components of the rail according to the present embodiment, the austenite transformation completion temperature is generally in a range of 720° C. to 900° C.

Wear test specimens were cut out from the head portions of the rails, and the wear resistance of the rails was evaluated.

<Method for Carrying Out Wear Test>

Tester: Nishihara-type wear tester (see FIG. 8)

Test specimen shape: Cylindarical test specimen (outer diameter: 30 mm, thickness: 8 mm), a rail material 4 in FIG. 8

Test specimen-sampling method: Cylindarical test specimens were cut out from the head surface portions of the test rails so that the upper surfaces of the cylindarical test specimens were located 2 mm below the head surfaces of the test rails and the lower surfaces of the cylindarical test specimens were located 10 mm below the head surfaces of the test rails (see FIG. 7)

Contact surface pressure: 840 MPa

Slip ratio: 9%

Opposite material: Pearlite steel (Hv 380), a wheel material 5 in FIG. 8

Test atmosphere: Air atmosphere

Cooling method: Forced cooling using compressed air in which a cooling air nozzle 6 in FIG. 8 was used (flow rate: 100 Nl/min).

The number of repetitions: 500,000 times

FIG. 1 shows the relationship between the amount of carbon in steel and the wear amount in the test rails (test steel group A). It was clarified from the graph of FIG. 1 that the wear amounts of the head surface portions of the rails have a correlation with the amount of carbon in the steel, and the wear resistance is significantly improved by an increase in the amount of carbon in the steel. Particularly, in steel having an amount of carbon of 0.70% or more, it was confirmed that the wear amount significantly decreases, and the wear resistance significantly improves.

(2. Relationship Between Amount of Carbon and Surface Damage Resistance)

Furthermore, the present inventors evaluated the surface damage resistance of the rails using a method in which an actual wheel was repeatedly brought into rolling contact with the test rails (test steel group A) (rolling contact fatigue test). Meanwhile, the rolling contact test conditions were as described below.

<Method for Carrying Out Rolling Contact Fatigue Test>

Tester: A rolling contact fatigue tester (see FIG. 9)

Test specimen shape: A rail (2 m 141 pound rail, a test rail 8 in FIG. 9)

Wheel: Association of American Railroads (AAR)-type (diameter: 920 mm), a wheel 9 in FIG. 9

Radial load and Thrust load: 50 kN to 300 kN, and 100 kN, respectively (value for reproducing the repetitive contact between curved rails and wheels)

Lubricant: Dry+oil (intermittent oil supply)

The number of repetitions: Until damage was generated (in a case in which damage was not generated, a maximum of 1.4 million times of rolling)

Figure 2:
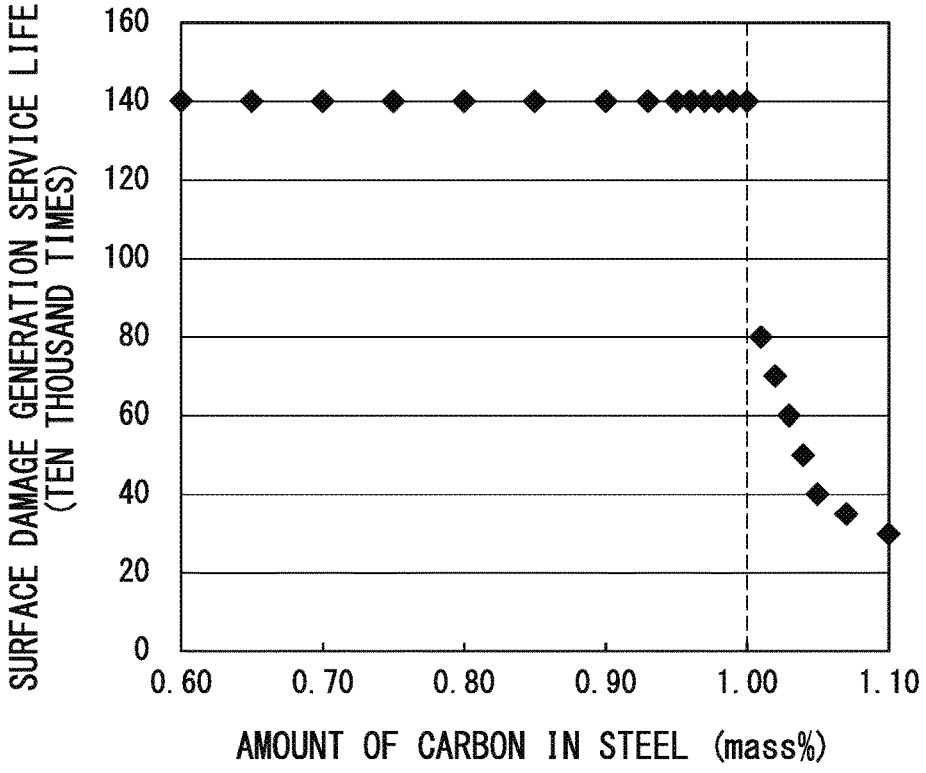
FIG. 2 is a graph showing a relationship between the amount of carbon in steel and a surface damage generation service life in the test rails (test steel group A).

In the rolling contact fatigue test, the number of times of rolling until surface damage was generated in the test rail 8 was obtained, and this number was considered to be the surface damage generation service life of the test rail 8. The surface damage generation service life of the test rail 8 in which no surface damage was generated due to 1.4 million times of rolling was considered to be "1.4 million times or more". The presence or absence of the generation of surface damage was determined by visually observing the full length of the rolling contact surface of the test rail. Rails in which 1 mm or longer cracking or 1 mm or wider exfoliation occurred were considered to be rails in which surface damage was generated. FIG. 2 shows the relationship between the amount of carbon in steel and the surface damage generation service life in the test rails (test steel group A).

As is clear from the graph of FIG. 2, it was found that the surface damage generation service life of the head surface portions of the rails has a correlation with the amount of carbon in steel. In addition, it was confirmed that, when the amount of carbon in steel exceeds 1.00%, it becomes possible to further reduce the wear amounts of the head surface portions of the rails as shown in FIG. 1; on the other hand, as shown in FIG. 2, the surface damage generation service life is reduced due to the generation of rolling contact fatigue damage, and the surface damage resistance significantly degrades.

From the above-described results, it became clear that, in order to improve the wear resistance as well as to ensure surface damage resistance of head surface portions of rails constituted of steel having mixed structures of pearlite structures and bainite structures, it is necessary to set the amount of carbon in steel in a certain range.

(3. Relationship Between Area Ratio of Bainite and Wear Resistance)

Furthermore, in order to clarify the optimal ratio between pearlite structures having excellent wear resistance and bainite structures having excellent surface damage resistance, first, the present inventors carried out wear tests on test rails in which the total area ratios of pearlite structures and bainite structures in head surface portions were 95% or more and bainite structures having a variety of area ratios were provided in head surface portions (test steel groups B1 to B3) and verified wear resistance.

Meanwhile, the components, heat treatment conditions, and wear test conditions of test steel groups B1 to B3 are as described below. The area ratios of bainite structures were adjusted by changing holding times at temperatures after the stoppage of accelerated-cooling.

<Chemical Components of Test Steel Groups B1 to B3>

C: 0.70% (test steel group B1), 0.90% (test steel group B2), or 1.00% (test steel group B3);

Si: 0.50%;

Mn: 0.60%

Cr: 1.00%;

P: 0.0150%;

S: 0.0120%; and a remainder: Fe and impurities

The following heat treatment was carried out on steel having the above-described chemical components, thereby producing test steel groups B1 to B3 (rails).

<Heat Treatment Conditions of Test Steel Groups B1 to B3>

Heating temperature: 950° C. (temperature of austenite transformation completion temperature+30° C. or higher)

Holding time at the above-described heating temperature: 30 min

Cooling conditions: After the above-described holding time elapsed, the rails were acceleratively-cooled to accelerated-cooling stoppage temperatures in a temperature range of 600° C. to 650° C. at a cooling rate of 5.0° C./sec, were held at the accelerated-cooling stoppage temperatures for 0 sec to 500 sec, furthermore, were acceleratively-cooled to 400° C. at 5.0° C./sec, and were naturally-cooled to room temperature.

<Structure Observation Method for Test Steel Groups B1 to B3>

Identical to the above-described structure observation method for test steel group A <Hardness Measurement Method for Test Steel Groups B1 to B3>

Identical to the above-described hardness measurement method for test steel group A <Hardness of Test Steel Groups B1 to B3>

Hardness: Hv 400 to Hv 500

Wear test specimens were cut out from the head portions of the rails, and the wear resistance of the rails was evaluated.

<Method for Carrying Out Wear Test>

Figure 3:
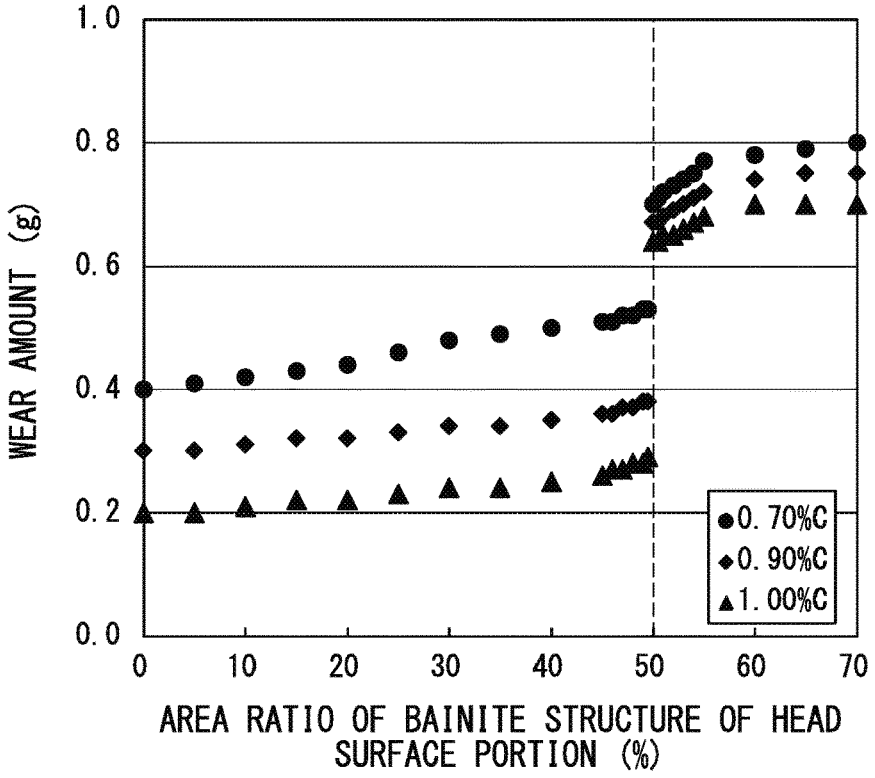
FIG. 3 is a graph showing relationships between an area ratio of bainite structures and a wear amount of head surface portions of rails in test rails (test steel groups B1 to B3).

Identical to the above-described wear test method carried out on test steel group A FIG. 3 shows the relationships between the area ratio of bainite structures and the wear amount of head surface portions of rails in the test rails (test steel groups B1 to B3). Meanwhile, the area ratio of the bainite structures was constant for all the test surfaces (outer circumferential portions) of cylindarical test specimens. From the graph of FIG. 3, it was confirmed that, even in all test steel groups, when the area ratios of the bainite structures in the head surface portions of the rails are less than 50%, the wear amounts are reduced, and the wear resistance significantly improves.

(4. Relationship Between Area Ratio of Bainite and Surface Damage Resistance)

Furthermore, the present inventors evaluated the surface damage resistance by means of rolling contact fatigue tests using the rails of the above-described test steel groups B1, B2, and B3 which were used in the wear tests. Meanwhile, the rolling contact fatigue test conditions are as described below.

<Method for Carrying Out Rolling Contact Fatigue Tests for Test Steel Groups B1 to B3>

Identical to the above-described method for carrying out rolling contact fatigue tests carried out on test steel group A <Structure Observation Method of Regions from Head Surfaces of Test Steel Groups B1 to B3 to a Depth of 10 mm>

Figure 4:
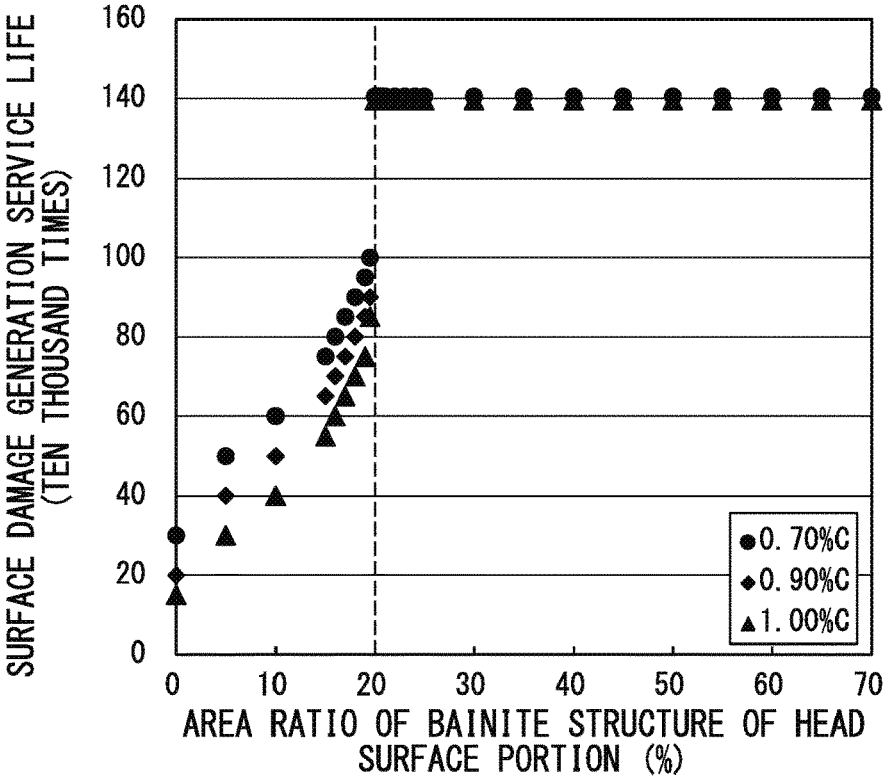
FIG. 4 is a graph showing relationships between an area ratio of bainite structures and a surface damage generation service life of head surface portions of rails in test rails (test steel groups B1 to B3).

Identical to the above-described structure observation method carried out on test steel group A FIG. 4 shows the relationships between the area ratio of the bainite structure and the surface damage generation service life of the head surface portions of the rails in the test rails (test steel groups B1 to B3). Meanwhile, the wear amounts of test specimens on which the rolling contact fatigue test was repeated a maximum of 1.4 million times were on average approximately several millimeters.

From the graph of FIG. 4, it is found that there is a correlation between the surface damage generation service life of test steel groups B1 to B3 having mixed structures and the area ratios of the bainite structures in the head surface portions of the rails. In addition, in all of the test steel groups, in a case in which the area ratio of the bainite structure in the head surface portion of the rail is less than 20%, an effect of improving the surface damage resistance of bainite steel cannot be sufficiently obtained, and thus the surface damage generation service life is reduced due to the generation of rolling contact fatigue damage.

From the above-described results, it became clear that, in steel having mixed structures, in order to ensure wear resistance using pearlite structures and, furthermore, improve the surface damage resistance using bainite structures, it is necessary to control the amount of carbon in steel to be in an appropriate range and, furthermore, control the area ratio of the bainite structure in the head surface portion of the rail to be in an appropriate range.

(5. Relationship Between Hardness and Surface Damage Resistance)

Furthermore, in order to understand the influence of the hardness of the head surface portion of the rail on the surface damage resistance in the head surface portion of the rail, the present inventors produced test rails in which hardness was differentiated, the amount of carbon was set to 0.70%, 0.90%, or 1.00%, and mixed structures of pearlite structures and bainite structures were provided (test steel groups C1 to C3) and evaluated the surface damage resistance of these test rails by means of rolling contact tests. Meanwhile, the components, heat treatment conditions, and rolling contact test conditions of test steel groups C1 to C3 are as described below.

<Chemical Components of Test Steel Groups C1 to C3>

C: 0.70% (test steel group C1), 0.90% (test steel group C2), or 1.00% (test steel group C3);

Si: 0.50%;

Mn: 0.60%

Cr: 1.00%;

P: 0.0150%;

S: 0.0120%; and a remainder: Fe and impurities

Hot-rolling and the following heat treatment were carried out on steel having the above-described chemical components, thereby producing the test steel groups C1 to C3 (rails).

<Heat Treatment Conditions of Test Steel Groups C1 to C3>

Heating temperature: 950° C. (temperature of austenite transformation completion temperature+30° C. or higher)

Holding time at the above-described heating temperature: 30 min

Cooling conditions: After the above-described holding time elapsed, the rails were acceleratively-cooled to a temperature range of 600° C. to 650° C. (accelerated-cooling stoppage temperatures) at a cooling rate of 5.0° C./sec, then, were held at the accelerated-cooling stoppage temperatures for 100 sec, furthermore, were acceleratively-cooled to 350° C. to 550° C. at a cooling rate of 1.0° C./sec to 20.0° C./sec, and were naturally-cooled to room temperature.

<Hardness Measurement Method of Regions from Head Surfaces of Test Steel Groups C1 to C3 to a Depth of 10 mm>

Identical to the above-described hardness measurement method for test steel group A <Structure Observation Method of Regions from Head Surfaces of Test Steel Groups C1 to C3 to a Depth of 10 mm>

Identical to the above-described structure observation method carried out on test steel group A <Structures and Hardness of Regions from Head Surfaces of Test Steel Groups C1 to C3 to a Depth of 10 mm>

Mixed structures pearlite: 60% by area to 70% by area, bainite: 30% by area to 40% by area Hardness: Hv 340 to Hv 540

The surface damage resistance of the rails were evaluated using a method in which an actual wheel was repeatedly brought into rolling contact with on test rail groups C1 to C3 (rails).

<Method for Carrying Out Rolling Contact Fatigue Test>

Figure 5:
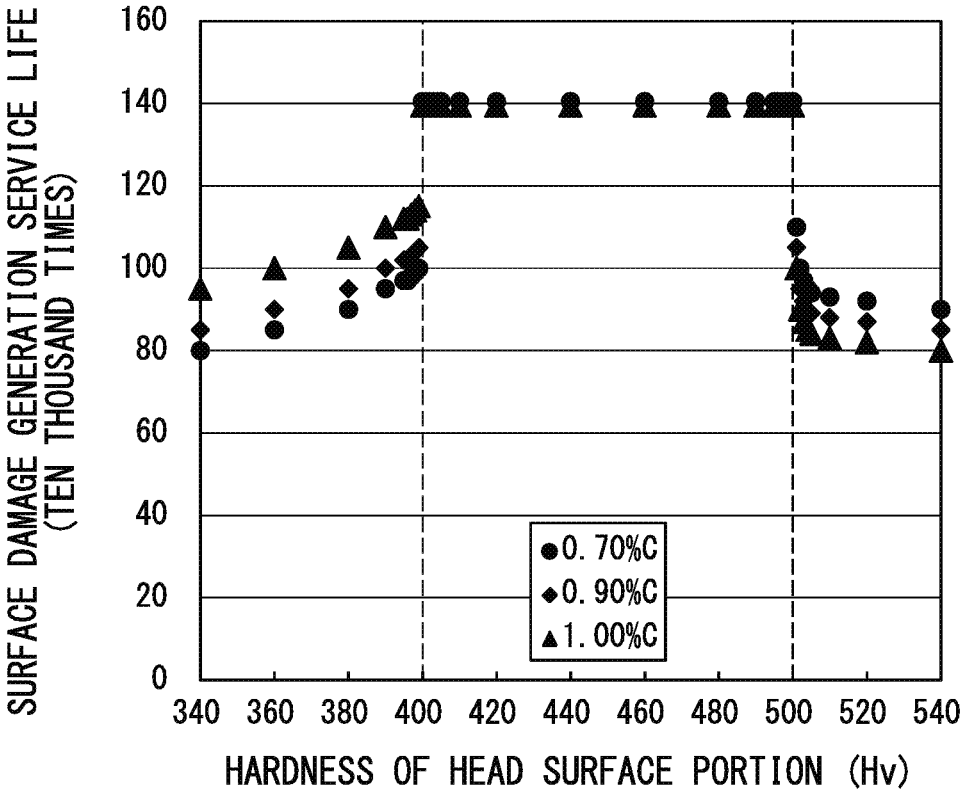
FIG. 5 is a graph showing relationships between hardness and a surface damage generation service life of head surface portions of rails in test rails (test steel groups C1 to C3).

Carried out in the same manner as in the above-described rolling contact fatigue test for test steel group A FIG. 5 shows the relationships between the hardness and the surface damage generation service life of the head surface portions of the rails in test rails (test steel groups C1 to C3). Meanwhile, the wear amounts of test specimens on which the rolling contact fatigue test was repeated a maximum of 1.4 million times were approximately several millimeters on average.

From the graph of FIG. 5, it is found that there is a correlation between the surface damage generation service life of test steel groups C1 to C3 having mixed structures and the hardness of the head surface portions. In addition, it was confirmed that, in a case in which the hardness of the head surface portions of the rails exceeds Hv 500, the hardness of the head surface portions of the rails becomes excessive, the wear acceleration effect is reduced, the surface damage generation service life is reduced due to the generation of rolling contact fatigue damage, and the surface damage resistance significantly degrades. On the other hand, it was confirmed that, in a case in which the hardness of the head surface portions of the rails is lower than Hv 400, plastic deformation develops on rolling surfaces, the generation of rolling contact fatigue damage attributed to the plastic deformation reduces surface damage generation service life, and the surface damage resistance of the head surface portion of the rail significantly degrades. That is, it was found that, when the hardness of the head surface portions of the rails including mixed structures of pearlite structures and bainite structures is set in a range of Hv 400 to Hv 500, it becomes possible to stably degrade the surface damage resistance.

From the above-described results, it became clear that, in order to ensure the wear resistance of the head surface portions of the rails constituted of mixed structures having pearlite structures and bainite structures and, furthermore, improve the surface damage resistance, there are optimal ranges for the amount of carbon, the area ratio of bainite structures, and the hardness of the head surface portions of the rails having the mixed structures.

Furthermore, the present inventors studied heat treatment conditions for controlling the area ratios of bainite structures in the head surface portions of the rails and, furthermore, the hardness of the head surface portions of the rails. Specifically, steel ingots having an amount of carbon of 0.80% were melted, and these steel ingots were hot-rolled, thereby producing material rails. Heat treatment tests were carried out using these material rails, and the relationship between heat treatment conditions and hardness and the relationship between heat treatment conditions and metallographic structures were studied.

As a result, it was confirmed that, when material rails are obtained by hot-rolling steel ingots, then, the head surfaces of the material rails are acceleratively-cooled, the temperatures of the head surfaces of the material rails are held in the transformation temperature region of pearlite structures for a certain period of time, then, furthermore, the head surfaces of the material rails are acceleratively-cooled, the accelerated-cooling is stopped in the transformation temperature region of bainite structures, and then the material rails are naturally-cooled, preferred mixed structures are formed.

Furthermore, it was confirmed that the area ratios of bainite structures can be controlled by the adjustment of the holding time in the transformation temperature region of pearlite structures, and additionally, the hardness of the head surface portions of the rails can be controlled by the selection of the accelerated-cooling stoppage temperature and the holding temperature in the transformation temperature region of pearlite structures and the selection of the accelerated-cooling stoppage temperature in the transformation temperature region of bainite structures.

That is, the present invention relates to a rail intended to improve the wear resistance and the surface damage resistance of rails used in curved sections for freight railways by controlling the chemical components of steel used for rails (rail steel), the area ratios of pearlite structures and bainite structures in head surface portions of the rails, and, furthermore, controlling the hardness of head surface portions of rails, thereby significantly improving the service life.

A rail according to an aspect of the present invention includes a rail head portion having a top head portion which is a flat region extending toward a top portion of the rail head portion in a extending direction of the rail, a side head portion which is a flat region extending toward a side portion of the rail head portion in the extending direction of the rail; and a corner head portion which is a region combining a rounded corner portion extending between the top head portion and the side head portion and an upper half of the side head portion, wherein the rail contains as a chemical components, in terms of mass %, C: 0.70% to 1.00%, Si: 0.20% to 1.50%, Mn: 0.20% to 1.00%, Cr: 0.40% to 1.20%, P: 0.0250% or less, S: 0.0250% or less, Mo: 0% to 0.50%, Co: 0% to 1.00%, Cu: 0% to 1.00%, Ni: 0% to 1.00%, V: 0% to 0.300%, Nb: 0% to 0.0500%, Mg: 0% to 0.0200%, Ca: 0% to 0.0200%, REM: 0% to 0.0500%, B: 0% to 0.0050%, Zr: 0% to 0.0200%, N: 0% to 0.0200%, and a remainder of Fe and impurities; in a region from a head surface constituted of a surface of the top head portion and a surface of the corner head portion to a depth of 10 mm, a total amount of pearlite structures and bainite structures is 95% by area or more, and an amount of the bainite structures is 20% by area or more and less than 50% by area, and an average hardness of the region from the head surface to a depth of 10 mm is in a range of Hv 400 to Hv 500. The rail according to the aspect of the present invention may contain as the chemical components, in terms of mass %, one or more selected from the group consisting of Mo: 0.01% to 0.50%, Co: 0.01% to 1.00%, Cu: 0.05% to 1.00%, Ni: 0.05% to 1.00%, V: 0.005% to 0.300%, Nb: 0.0010% to 0.0500%, Mg: 0.0005% to 0.0200%, Ca: 0.0005% to 0.0200%, REM: 0.0005% to 0.0500%, B: 0.0001% to 0.0050%, Zr: 0.0001% to 0.0200%, and N: 0.0060% to 0.0200%.

Next, the constitution requirements and the limitation reasons of the rail according to the aspect of the present invention will be described in detail. Meanwhile, in the following description, the units "mass %" for chemical components of steel will be simply denoted as (1) Reasons for Limiting Chemical Components of Steel The reasons for limiting the chemical components of steel constituting the rail of the present embodiment to the above-described numeric ranges will be described in detail.

(C: 0.70% to 1.00%)

C is an effective element for ensuring the wear resistance of pearlite structures and bainite structures. When the amount of C is less than 0.70%, as shown in FIG. 1, the favorable wear resistance of the head surface portion of the rail according to the present embodiment cannot be maintained. On the other hand, when the amount of C exceeds 1.00%, as shown in FIG. 2, the wear resistance of the head surface portion of the rail becomes excessive, the surface damage generation service life is reduced due to the generation of rolling contact fatigue damage, and the surface damage resistance significantly degrades.

Therefore, the amount of C is limited to 0.70% to 1.00%. Meanwhile, in order to stably improve the wear resistance of the head surface portion of the rail, the amount of C is desirably set to 0.72% or more and more desirably set to 0.75% or more. In addition, in order to limit an excessive increase in the wear resistance of the head surface portion of the rail and stably improve the surface damage resistance of the head surface portion of the rail, the amount of C is desirably set to 0.95% or less and more desirably set to 0.90% or less.

(Si: 0.20% to 1.50%)

Si is an element that forms solid solutions in ferrite which is a basic structure of pearlite structures and bainite structures, increases the hardness (strength) of the head surface portion of the rail, and improves the surface damage resistance of the head surface portion of the rail. However, when the amount of Si is less than 0.20%, these effects cannot be sufficiently expected. On the other hand, when the amount of Si exceeds 1.50%, a number of surface cracks are generated during hot-rolling. Furthermore, when the amount of Si exceeds 1.50%, hardenability significantly increases, martensite structures are generated in the head surface portion of the rail, and the wear resistance or the surface damage resistance degrades. Therefore, the amount of Si is limited to 0.20% to 1.50%. Meanwhile, in order to ensure the hardness of the mixed structures and improve the surface damage resistance of the head surface portion of the rail, the amount of Si is desirably set to 0.25% or more and more desirably set to 0.40% or more. In addition, in order to limit the generation of martensite structures and, furthermore, improve the wear resistance and the surface damage resistance of the head surface portion of the rail, the amount of Si is desirably set to 1.20% or less and is more desirably set to 1.00% or less.

(Mn: 0.20% to 1.00%)

Mn is an element that enhances hardenability, miniaturizes the lamellar spacing of pearlite structures, and improves the hardness of pearlite structures, thereby improving the wear resistance of the head surface portion of the rail. Furthermore, Mn is an element that accelerates bainitic transformation and miniaturizes the base structures (ferrite) of bainite structures and carbides, thereby improving the hardness (strength) of bainite structures and improving the surface damage resistance of the head surface portion of the rail. However, when the amount of Mn is less than 0.20%, the effect of improving the hardness of pearlite structures and the effect of accelerating bainitic transformation are insufficient, and thus the surface damage resistance of the head surface portion of the rail does not sufficiently improve. In addition, when the amount of Mn exceeds 1.00%, hardenability significantly increases, martensite structures are generated in the head surface portion of the rail, and the surface damage resistance and the wear resistance of the head surface portion of the rail degrade. Therefore, the amount of Mn is limited to 0.20% to 1.00%. In order to stabilize the generation of mixed structures and improve the surface damage resistance of the head surface portion of the rail, the amount of Mn is desirably set to 0.35% or more and more desirably set to 0.40% or more. In addition, in order to limit the generation of martensite structures and stably improve the wear resistance and the surface damage resistance of the head surface portion of the rail, the amount of Mn is desirably set to 0.85% or less and is more desirably set to 0.80% or less.

(Cr: 0.40% to 1.20%)

Cr increases the equilibrium transformation temperature of pearlite and is thus an element that miniaturizes the lamellar spacing of pearlite structures and improves the hardness (strength) of pearlite structures by increasing the degree of supercooling. Furthermore, Cr is an element that accelerates bainitic transformation, miniaturizes the base structures (ferrite) of bainite structures and carbides, and improves the hardness (strength) of bainite structures, thereby improving the surface damage resistance of the head surface portion of the rail. However, when the amount of Cr is less than 0.40%, those effects are weak, as the amount of Cr decreases, the effect of improving the hardness of pearlite structures and the effect of accelerating bainitic transformation become more insufficient, and the surface damage resistance of the head surface portion of the rail does not sufficiently improve. On the other hand, in a case in which the amount of Cr exceeds 1.20%, the hardenability significantly increases, martensite structures are generated in the head surface portion of the rail, and the surface damage resistance and the wear resistance of the head surface portion of the rail degrade. Therefore, the amount of Cr is limited to 0.40% to 1.20%. In order to stabilize the generation of mixed structures and improve the wear resistance and the surface damage resistance of the head surface portion of the rail, the amount of Cr is desirably set to 0.50% or more and more desirably set to 0.60% or more. In addition, in order to limit the generation of martensite structures and stably improve the wear resistance and the surface damage resistance of the head surface portion of the rail, the amount of Cr is desirably set to 1.10% or less and more desirably set to 1.00% or less.

(P: 0.0250% or Less)

P is an impurity element included in steel. The amount thereof can be controlled by refining steel in converters. When the amount of P exceeds 0.0250%, the head surface portion of the rail becomes brittle, and the surface damage resistance of the head surface portion of the rail degrades. Therefore, the amount of P is controlled to be 0.0250% or less. The amount of P is desirably controlled to be 0.220% or less and more desirably controlled to be 0.0180% or less. The lower limit of the amount of P is not limited; however, when dephosphorization capabilities in refining are taken into account, the substantial lower limit of the amount of P is considered to be approximately 0.0020%. Therefore, in the present embodiment, the lower limit value of the amount of P may be set to 0.0020% or 0.0080%.

(S: 0.0250% or Less)

S is an impurity element included in steel. The amount thereof can be controlled by refining steel in hot-metal ladles. When the amount of S exceeds 0.0250%, inclusions of coarse MnS-based sulfides are likely to be generated, in the head surface portion of the rail, fatigue cracks are generated due to stress concentration generated around the inclusions, and the surface damage resistance degrades. Therefore, the amount of S is controlled to be 0.0250% or less. The amount of S is desirably controlled to be 0.0210% or less and more desirably controlled to be 0.0180% or less. Meanwhile, the lower limit of the amount of S is not limited; however, when desulfurization capabilities in refining are taken into account, the substantial lower limit of the amount of S is considered to be approximately 0.0020%. Therefore, in the present embodiment, the lower limit value of the amount of S may be set to 0.0020% or 0.0080%.

Furthermore, in order for improvement in the surface damage resistance by the stabilization of mixed structures, improvement in wear resistance by an increase in the hardness (strength) and the like, improvement in toughness, prevention of softening of heat affected zones, and the control of the cross-sectional hardness distribution in the head portion, the chemical components of the rail according to the present embodiment may contain, as necessary, one or more of Mo, Co, Cu, Ni, V, Nb, Mg, Ca, REM, B, Zr, and N. However, the rail according to the present embodiment does not need to contain these elements, and thus the lower limit values of these elements are 0%.

Here, the actions and effects of Mo, Co, Cu, Ni, V, Nb, Mg, Ca, REM, B, Zr, and N in the rail according to the present embodiment will be described.

Mo has effects of increasing the equilibrium transformation point, miniaturizing the lamellar spacing of pearlite structures, and improving the hardness of the head surface portion of the rail. Furthermore, Mo has effects of accelerating the generation of bainite structures, miniaturizing the base structures (ferrite) of bainite structures and carbides, and improving the hardness of the head surface portion of the rail.

Co has effects of miniaturizing the base structures (ferrite) of bainite structures on worn surfaces (head surface) and enhancing the wear resistance of the head surface portion of the rail.

Cu has effects of forming solid solutions in ferrite in pearlite structures and bainite structures and enhancing the hardness of the head surface portion of the rail.

Ni has effects of improving the toughness and the hardness of pearlite structures and bainite structures at the same time and preventing the softening of heat affected zones in weld joints.

V has effects of strengthening pearlite structures and bainite structures by precipitation strengthening occurred by carbides, nitrides, and the like generated during hot-rolling and subsequent cooling processes. In addition, V has effects of miniaturizing austenite grains when heat treatments for heating steel to high temperatures are carried out and improving the ductility and the toughness of bainite structures and pearlite structures.

Nb has effects of limiting the generation of pro-eutectoid ferrite structures which may be generated from prior austenite grain boundaries and stabilizing pearlite structures and bainite structures. In addition, Nb has effects of strengthening pearlite structures and bainite structures by precipitation strengthening occurred by carbides, nitrides, and the like generated during hot-rolling and subsequent cooling processes. Furthermore, Nb has effects of miniaturizing austenite grains when heat treatments for heating steel to high temperatures are carried out and improving the ductility and the toughness of bainite structures and pearlite structures.

Mg, Ca, and REM have effects of finely dispersing MnS-based sulfides and reducing fatigue damage generated from these MnS-based sulfides.

B reduces the cooling rate dependency of pearlitic transformation temperatures and uniforms the hardness distribution of the head surface portion of the rail. Furthermore, B has effects of inhibiting the generation of pro-eutectoid ferrite structures which may be generated during bainitic transformation and stably generating bainite structures.

Zr has effects of limiting the formation of segregation bands in central parts of bloom or slab and limiting the generation of martensite structures by increasing the equiaxed crystal ratios of solidification structures.

N has effects of accelerating the generation of nitrides of V and improving the hardness of the head surface portion of the rail.

(Mo: 0% to 0.50%)

Mo increases equilibrium transformation temperatures and miniaturizes the lamellar spacing of pearlite structures by increasing the degree of supercooling. Furthermore, similar to Mn or Cr, Mo is an element capable of increasing strength by stably generating bainite structures. In order to obtain these effects, the amount of Mo may be set to 0.01% or more. On the other hand, in a case in which the amount of Mo exceeds 0.50%, due to an excessive increase in hardenability, martensite structures are generated in the rail head surface portion, and the wear resistance degrades. Furthermore, rolling contact fatigue damage is generated in the head surface portion of the rail, and there are concerns that surface damage resistance may degrade. Furthermore, in a case in which the amount of Mo exceeds 0.50%, there are concerns that segregation may be promoted in bloom or slab and martensite structures which are harmful to toughness may be generated in segregated portions. Therefore, the amount of Mo is desirably set to 0.50% or less. The lower limit value of the amount of Mo may be set to 0.02% or 0.03%. In addition, the upper limit value of the amount of Mo may be set to 0.45% or 0.40%.

(Co: 0% to 1.00%)

Co is an element that forms solid solutions in the base structures (ferrite) of bainite structures, miniaturizes the base structures (ferrite) of bainite structures on worn surfaces, increases the hardness of the worn surfaces, and improves the wear resistance of the head surface portion of the rail. In order to obtain these effects, the amount of Co may be set to 0.01% or more. On the other hand, when the amount of Co exceeds 1.00%, the above-described effects are saturated, and structures cannot be miniaturized in accordance with the amount thereof. In addition, when the amount of Co exceeds 1.00%, an increase in raw material costs is caused, and economic efficiency degrades. Therefore, the amount of Co is desirably set to 1.00% or less. The lower limit value of the amount of Co may be set to 0.02% or 0.03%. In addition, the upper limit value of the amount of Co may be set to 0.95% or 0.90%.

(Cu: 0% to 1.00%)

Cu is an element that forms solid solutions in the base structures (ferrite) of pearlite structures and bainite structures and improves the strength of the head surface portion of the rail by solid solution strengthening. In order to obtain these effects, the amount of Cu may be set to 0.05% or more. On the other hand, when the amount of Cu exceeds 1.00%, due to excessive improvement in hardenability, there are concerns that martensite structures which are harmful to the wear resistance and the surface damage resistance of the head surface portion of the rail are likely to be generated. Therefore, the amount of Cu is desirably set to 1.00% or less. The lower limit value of the amount of Cu may be set to 0.07% or 0.10%. In addition, the upper limit value of the amount of Cu may be set to 0.95% or 0.90%.

(Ni: 0% to 1.00%)

Ni has effects of improving the toughness of pearlite structures and bainite structures in the head surface portion of the rail, simultaneously, forming solid solutions in ferrites which is a base structure of pearlite structures and ferrite which is a base structure of bainite structures and improving the strength of the head surface portion of the rail by solid solution strengthening. Furthermore, Ni is also an element that stabilizes austenite and also has effects of lowering bainitic transformation temperatures, miniaturizing bainite structures, and improving the strength and toughness of the head surface portion of the rail. In order to obtain these effects, the amount of Ni may be set to 0.05% or more. On the other hand, when the amount of Ni exceeds 1.00%, the transformation rates of mixed structures significantly decrease, and there are concerns that martensite structures which are harmful to the wear resistance and the surface damage resistance of the head surface portion of the rail are likely to be generated. Therefore, the amount of Ni is desirably set to 1.00% or less. The lower limit value of the amount of Ni may be set to 0.07% or 0.10%. In addition, the upper limit value of the amount of Ni may be set to 0.95% or 0.90%.

(V: 0% to 0.300%)

V is an effective component for increasing the strength of the head surface portion of the rail by means of precipitation hardening occurred by V carbides and V nitrides generated in cooling processes during hot-rolling. Furthermore, V has an action of limiting the growth of crystal grains when heat treatments for heating steel to high temperatures are carried out and is thus an effective component for miniaturizing austenite grains and improving the ductility and the toughness of the head surface portion of the rail. In order to obtain these effects, the amount of V may be set to 0.005% or more. On the other hand, when the amount of V exceeds 0.300%, the above-described effects are saturated, and thus the amount of V is desirably set to 0.300% or less. The lower limit value of the amount of V may be set to 0.007% or 0.010%. In addition, the upper limit value of the amount of V may be set to 0.250% or 0.200%.

(Nb: 0% to 0.0500%)

Nb is an element that limits the generation of proeutectoid ferrite structures which are, in some cases, generated from prior austenite grain boundaries and stably generates bainite structures by means of an increase in hardenability. In addition, Nb is an effective component for increasing the strength of the head surface portion of the rail by means of precipitation hardening occurred by Nb carbides and Nb nitrides generated in cooling processes during hot-rolling. Furthermore, Nb has an action of limiting the growth of crystal grains when heat treatments for heating steel to high temperatures are carried out and is thus an effective component for miniaturizing austenite grains and improving the ductility and the toughness of the head surface portion of the rail. In order to obtain these effects, the amount of Nb may be set to 0.0010% or more. On the other hand, when the amount of Nb exceeds 0.0500%, intermetallic compounds and coarse precipitates of Nb (Nb carbides) are generated, and there are concerns that the toughness of the head surface portion of the rail may degrade, and thus the amount of Nb is desirably set to 0.0500% or less. The lower limit value of the amount of Nb may be set to 0.0015% or 0.0020%. In addition, the upper limit value of the amount of Nb may be set to 0.0450% or 0.0400%.

(Mg: 0% to 0.0200%)

Mg bonds with S so as to form fine sulfides (MgS), and this MgS finely disperses MnS, mitigates stress concentration generated around MnS, and improves the fatigue damage resistance of the head surface portion of the rail. In order to obtain these effects, the amount of Mg may be set to 0.0005% or more. On the other hand, when the amount of Mg exceeds 0.0200%, coarse oxides of Mg are generated, fatigue cracks are generated due to stress concentration generated around these coarse oxides, and there are concerns that the fatigue damage resistance of the head surface portion of the rail may degrade. Therefore, the amount of Mg is desirably set to 0.0200% or less. The lower limit value of the amount of Mg may be set to 0.0008% or 0.0010%. In addition, the upper limit value of the amount of Mg may be set to 0.0180% or 0.0150%.

(Ca: 0% to 0.0200%)

Ca is an element that has a strong bonding force with S and forms sulfides (CaS). This CaS finely disperses MnS, mitigates stress concentration generated around MnS, and improves the fatigue damage resistance of the head surface portion of the rail. In order to obtain these effects, the amount of Ca may be set to 0.0005% or more. On the other hand, when the amount of Ca exceeds 0.0200%, coarse oxides of Ca are generated, fatigue cracks are generated due to stress concentration generated around these coarse oxides, and there are concerns that the fatigue damage resistance of the head surface portion of the rail may degrade. Therefore, the amount of Ca is desirably set to 0.0200% or less. The lower limit value of the amount of Ca may be set to 0.0008% or 0.0010%. In addition, the upper limit value of the amount of Ca may be set to 0.0180% or 0.0150%.

(REM: 0% to 0.0500%)

REM are elements having a deoxidizing and desulfurizing effect and generates oxysulfide ($REM_2O_2S$). $REM_2O_2S$ serves as generation nuclei of Mn sulfide-based inclusions. $REM_2O_2S$ has a high melting point and thus is not melted during hot-rolling and prevents Mn sulfide-based inclusions from stretching due to hot-rolling. As a result, $REM_2O_2S$ finely disperses MnS and mitigates stress concentration generated around MnS, whereby the fatigue damage resistance of the head surface portion of the rail can be improved. In order to obtain these effects, the amount of REM may be set to 0.0005% or more. On the other hand, when the amount of REM exceeds 0.0500%, full hard $REM_2O_2S$ is excessively generated, fatigue cracks are generated due to stress concentration generated around $REM_2O_2S$, and there are concerns that the fatigue damage resistance of the head surface portion of the rail may degrade. Therefore, the amount of REM is desirably set to 0.0500% or less. The lower limit value of the amount of REM may be set to 0.0008% or 0.0010%. In addition, the upper limit value of the amount of REM may be set to 0.0450% or 0.0400%.

Meanwhile, REM represents rare earth metals such as Ce, La, Pr, and Nd. "The amount of REM" refers to the total value of the amounts of all of these rare earth metals. When the total of the amounts of rare earth metals is within the above-described range, the same effects can be obtained regardless of the kinds of rare earth metal.

(B: 0% to 0.0050%)

B has effects of forming iron boron carbide ($Fe_{23}(CB)_6$) in austenite grain boundaries. This iron boron carbide has effects of accelerating pearlitic transformation and thus reduces the cooling rate dependency of pearlitic transformation temperatures and further evens the hardness distribution from the head surface to the inside. The evening of the hardness distribution reliably improves the wear resistance and the surface damage resistance of the head surface portion of the rail and improves the service life. Furthermore, B is an element that limits the generation of proeutectoid ferrite structures which are, in some cases, generated from prior austenite grain boundaries, stably generates bainite structures, and further improves the hardness of the head surface portion of the rail and the structure stability of the head surface portion of the rail. In order to obtain these effects, the amount of B may be set to 0.0001% or more. On the other hand, when the amount of B exceeds 0.0050%, these effects are saturated, and raw material costs are unnecessarily increased, and thus the amount of B is desirably set to 0.0050% or less. The lower limit value of the amount of B may be set to 0.0003% or 0.0005%. In addition, the upper limit value of the amount of B may be set to 0.0045% or 0.0040%.

(Zr: 0% to 0.0200%)

Zr generates $ZrO_2$-based inclusions. These $ZrO_2$-based inclusions have favorable lattice matching properties with γ-Fe and are thus an element that serves as a solidification nuclei of high-carbon rail steel in which γ-Fe is a solidified primary phase and increases the equiaxed crystal ratios of solidification structures, thereby limiting the formation of segregation bands in central parts of bloom or slab and limiting the generation of martensite structures in rail segregation portions. In order to obtain these effects, the amount of Zr may be set to 0.0001% or more. On the other hand, when the amount of Zr exceeds 0.0200%, a large amount of coarse Zr-based inclusions are generated, fatigue cracks are generated due to stress concentration generated around these coarse Zr-based inclusions, and there are concerns that the surface damage resistance may degrade. Therefore, the amount of Zr is desirably set to 0.0200% or less. The lower limit value of the amount of Zr may be set to 0.0003% or 0.0005%. In addition, the upper limit value of the amount of Zr may be set to 0.0180% or 0.0150%.

(N: 0% to 0.0200%)

N is an element that, in the case of being included together with V, generates nitrides of V in cooling processes after hot-rolling, increases the hardness (strength) of pearlite structures and bainite structures, and improves the surface damage resistance and the wear resistance of the head surface portion of the rail. In order to obtain these effects, the amount of N may be set to 0.0060% or more. On the other hand, when the amount of N exceeds 0.0200%, it becomes difficult to form solid solutions in steel, air bubbles which serves as starting points of fatigue damage are generated, and internal fatigue damage is likely to be generated in the head surface portion of the rail. Therefore, the amount of N is desirably set to 0.0200% or less. The lower limit value of the amount of N may be set to 0.0065% or 0.0070%. In addition, the upper limit value of the amount of N may be set to 0.0180% or 0.0150%.

The amounts of the alloy elements included in the chemical components of the rail according to the present embodiment are as described above, and the remainder of the chemical components is Fe and impurities. Impurities are incorporated into steel depending on the status of raw materials, materials, production facilities, and the like, and the incorporation of impurities is permitted as long as the characteristics of the rail according to the present embodiment are not impaired.

Rails having the above-described chemical components are obtained by carrying out melting in ordinarily-used melting furnaces such as converters or electric furnaces, casting molten steel obtained by the above-described melting using an ingot-making and blooming method or a continuous casting method, then, hot-rolling bloom or slab obtained by the above-described casting in rail shapes, and furthermore, carrying out heat treatments in order to control the metallographic structures and the hardness of the head surface portion of the rail.

(2) Reasons for Limiting Mixed Structures of Pearlite Structures and Bainite Structures Next, the reasons for forming the mixed structures of pearlite structures and bainite structures as the structure of the region from the rail head surface to a depth of 10 mm (the head surface portion of the rail) will be described.

(Area Ratio of the Mixed Structures of Pearlite Structures and Bainite Structures: 95% or Higher)

The present inventors investigated the metallographic structures in the head surface portion of the rail and characteristics thereof. As a result, it was found that pearlite structures having a lamellar structure of ferrite and cementite significantly improve the wear resistance of the rail. This is considered to be because the work hardening amount of the pearlite structures on the rolling contact surfaces of the head surface portion of the rail is great. On the other hand, it was confirmed that bainite structures having a structure in which granular hard carbides are dispersed in soft base ferrite suppress the generation of rolling contact fatigue damage and significantly improve surface damage resistance. This is considered to be because the work hardening amount of bainite structures on the rolling contact contact surfaces of the head surface portion of the rail is smaller than that of pearlite structures and thus the wear of the head surface portion of the rail is accelerated.

In order to improve both of wear resistance and surface damage resistance, the present inventors produced an idea of the application of mixed structures of pearlite structures that improve wear resistance and bainite structures that improve surface damage resistance to the head surface portion of the rail.

The metallographic structure of the head surface portion of the rail according to the present embodiment is desirably made of only mixed structures of pearlite structures and bainite structures. It is not preferable that structures other than pearlite structures and bainite structures such as pro-eutectoid ferrite structures, pro-eutectoid cementite structures, and martensite structures are incorporated into the metallographic structure of the head surface portion of the rail. However, when the area ratio of the structures other than pearlite structures and bainite structures is lower than 5%, there are no significant adverse effects on the wear resistance and the surface damage resistance of the head surface portion of the rail. Therefore, the structure of the head surface portion of the rail according to the present embodiment may include 5% or less of structures other than pearlite structures and bainite structures (that is, pro-eutectoid ferrite structures, pro-eutectoid cementite structures, martensite structures, and the like) in terms of the area ratio. In other words, the head surface portion of the rail according to the present embodiment needs to include 95% or more of the mixed structures of pearlite structures and bainite structures in terms of the area ratio (that is, the total amount of the pearlite structures and the bainite structures is 95% or more). Meanwhile, in order to sufficiently improve wear resistance and surface damage resistance, the structure of the head surface portion of the rail desirably includes 98% or more of the mixed structures of pearlite structures and bainite structures in terms of the area ratio. Meanwhile, pro-eutectoid ferrite is differentiated from ferrite which is the base structure of pearlite structures and bainite structures.

(Area Ratio of Bainite Structure: 20% or More and Less than 50%)

Next, the reasons for limiting the amount of bainite structures included in the metallo graphic structure of the region from the rail head surface to a depth of 10 mm to 20% by area or more and less than 50% by area will be described.

When the proportion of bainite structures is less than 20% by area, as shown in FIG. 4, the wear acceleration effect of bainite structures is weak, consequently, rolling contact fatigue damage is generated, and it becomes difficult to ensure the surface damage resistance of the head surface portion of the rail. In addition, when the amount of bainite structures is 50% by area or more, as shown in FIG. 3, the wear acceleration effect of bainite structures is significant, and it becomes difficult to ensure the wear resistance of the head surface portion of the rail. Therefore, the amount of bainite structures is set to 20% by area or more and less than 50% by area. Meanwhile, in order to stably ensure the surface damage resistance of the head surface portion of the rail, the amount of bainite structures is preferably set to 22% by area or more and more preferably set to 25% by area or more. In addition, in order to stably ensure the wear resistance of the head surface portion of the rail, the amount of bainite structures is preferably set to 49% by area or less and is more preferably set to 45% by area or less.

The area ratio of pearlite structures to the head surface portion of the rail according to the present embodiment is not particularly limited as long as the above-described regulations of the area ratio of the mixed structures and the regulations of the area ratio of bainite structures. Therefore, the area ratio of pearlite structures to the head surface portion of the rail according to the present embodiment is set to more than 45% and 80% or less on the basis of the above-described regulations of the area ratio of the mixed structures and the regulations of the area ratio of bainite structures.

(3) Reasons for Limiting Necessary Ranges of Metallographic Structures and Mixed Structures of Pearlite Structure and Bainite Structure.

Next, the reasons for forming the mixed structures of pearlite structures and bainite structures in the region from the rail head surface to a depth of 10 mm will be described.

Figure 6:
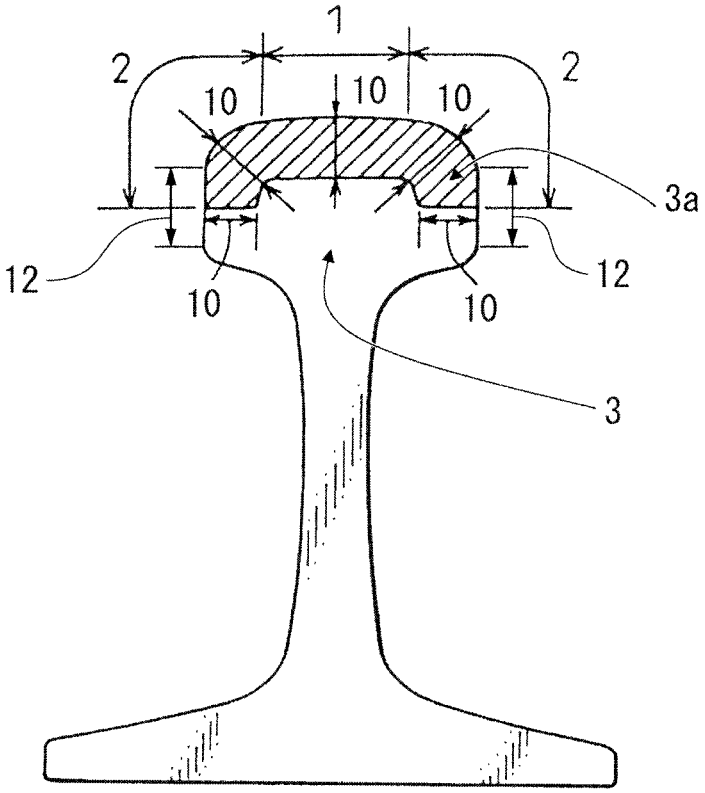
FIG. 6 is a schematic cross sectional view of a rail according to a first embodiment of the present invention.

FIG. 6 shows the constitution of the rail according to the present embodiment and a region requiring 95% by area or more of the mixed structures of pearlite structures and bainite structures. A rail head portion 3 includes a top head portion 1, a corner head portions 2 located on both ends of the top head portion 1, and a side head portion 12. The top head portion 1 is an approximately flat region extending toward the top portion of the rail head portion in the rail extending direction. The side head portion 12 is an approximately flat region extending toward the side portion of the rail head portion in the rail extending direction. The corner head portion 2 is a region combining a rounded corner portion extending between the top head portion 1 and the side head portion 12 and the upper half (the upper side of the half portion of the side head portion 12 in the vertical direction) of the side head portion 12. One of the two corner head portions 2 is a gauge corner (G.C.) portion that mainly comes into contact with wheels.

A region combining the surface of the top head portion 1 and the surface of the corner head portion 2 will be termed as the head surface of the rail. This region is a region in the rail which most frequently comes into contact with wheels. A region from the surfaces of the corner head portions 2 and the top head portion 1 (the head surface) to a depth of 10 mm will be termed as a head surface portion 3*a* (the shadow portion in the drawing).

As shown in FIG. 6, when the mixed structures of pearlite structures and bainite structures having a predetermined area ratio and predetermined hardness are disposed in the head surface portion 3*a* which is the region from the surface of the corner head portions 2 and the top head portion 1 to a depth of 10 mm, the wear resistance and the surface damage resistance of the head surface portion 3*a* of the rail sufficiently improve. Therefore, it is necessary that the mixed structures having the predetermined area ratio and the predetermined hardness are disposed in the head surface portion 3*a*, in which surface damage resistance and wear resistance are required since the head surface portion 3*a* is a place at which wheels and the rail mainly come into contact with each other. Meanwhile, the structures of portions not requiring the above-described characteristics other than the head surface portion 3*a* are not particularly limited.

In a case in which, only in regions from the head surface to a depth of less than 10 mm, the structures are controlled as described above, it is not possible to ensure surface damage resistance and wear resistance which are required in the head surface portion of the rail, and sufficient improvement in the rail service life becomes difficult. Meanwhile, ranges to which 95% by area or more of the mixed structures of pearlite structures and bainite structures is added may be regions from the head surface to a depth of more than 10 mm. In order to further improve surface damage resistance and wear resistance, it is desirable to form 95% by area or more of the mixed structures in regions from the head surface to a depth of approximately 30 mm.

The area ratio of bainite and the area ratio of the mixed structures at locations of an arbitrary depth from the head surface are obtained by, for example, observing the metallographic structures of the locations of the arbitrary depth in visual fields of optical microscopes with a magnification of 200 times. In addition, it is preferable that the above-described observation using optical microscopes is carried out 20 visual fields (20 places) or more at the locations of the arbitrary depth, and the average value of the area ratios of bainite structures and the average value of the area ratios of the mixed structures at the respective visual fields are considered to be the area ratio of bainite structures and the area ratio of the mixed structures included in the locations of the arbitrary depth.

When the area ratios of the mixed structures are 95% or higher in both a location of a depth of approximately 2 mm from the head surface and a location of a depth of approximately 10 mm from the head surface, it is possible to consider that 95% or more of the metallographic structures in regions from the head surface to a depth of at least 10 mm (the head surface portion of the rail) are mixed structures. In addition, it is possible to consider the average value of the area ratio of the mixed structures at a location of a depth of 2 mm from the head surface and the area ratio of the mixed structures at a location of a depth of 10 mm from the head surface as the area ratio of the average mixed structure of the entire region from the head surface to a depth of 10 mm. Similarly, when the area ratios of bainite structures are 20% to 50% in both a location of a depth of approximately 2 mm from the head surface and a location of a depth of approximately 10 mm from the head surface, it is possible to consider that 20% to 50% of the metallographic structures in regions from the head surface to a depth of at least 10 mm are bainite structures and consider the average value of the area ratio of bainite structure at a location of a depth of 2 mm from the head surface and the area ratio of bainite structure at a location of a depth of 10 mm from the head surface as the area ratio of the average bainite structure of the entire region from the head surface to a depth of 10 mm.

Meanwhile, the area ratios of structures other than bainite structures and pearlite structures (that is, pro-eutectoid ferrite structures, pro-eutectoid cementite structures, martensite structures, and the like) can be measured in the same manner as for the above-described area ratios of pearlite structures and bainite structures.

When the area ratios of structures other than bainite structures and pearlite structures are less than 5% in both a location of a depth of approximately 2 mm from the head surface and a location of a depth of approximately 10 mm from the head surface, it is possible to consider that the area ratios of structures other than bainite structures and pearlite structures in the structures of regions from the head surface to a depth of at least 10 mm is less than 5%.

(4) Reasons for Limiting Hardness of Head Surface Portion of Rail (Average Hardness of Ranges of Region from Head Surface to Depth of 10 mm: Hv 400 to Hv 500)

Next, the reasons for limiting the average hardness of a region from the head surface to a depth of 10 mm to a range of Hv 400 to Hv 500 will be described.

When the hardness of a region from the head surface to a depth of 10 mm (the head surface portion of the rail) is less than Hv 400, as shown in FIG. 5, plastic deformation develops on rolling contact surfaces, the generation of rolling contact fatigue damage attributed to the plastic deformation reduces surface damage generation service life, and the surface damage resistance of the head surface portion of the rail significantly degrades. In addition, when the hardness of the head surface portion of the rail exceeds Hv 500, as shown in FIG. 5, the wear acceleration effect of the head surface portion of the rail is reduced, the generation of rolling contact fatigue damage in the head surface portion of the rail reduces surface damage generation service life, and the surface damage resistance significantly degrades. Therefore, the hardness of the head surface portion of the rail is limited to a range of Hv 400 to Hv 500.

Meanwhile, in order to further limit the development of plastic deformation on rolling contact surfaces and sufficiently ensure surface damage resistance, the hardness of the region from the head surface to a depth of 10 mm (the head surface portion of the rail) is desirably set to Hv 405 or more and more desirably set to Hv 415 or more. In addition, in order to limit the reduction of the wear acceleration effect and sufficiently ensure surface damage resistance by further limiting the generation of rolling contact fatigue damage, the hardness of the region from the head surface to a depth of 10 mm (the head surface portion of the rail) is desirably set to Hv 498 or less and more desirably set to Hv 480 or less.

In a case in which the hardness is not controlled as described above only in regions from the head surface to a depth of less than 10 mm, sufficient improvement in rail characteristics becomes difficult. Meanwhile, regions having hardness of Hv 400 to Hv 500 may extend a depth of more than 10 mm from the head surface. The hardness of regions from the head surface to a depth of approximately 30 mm is desirably set to Hv 400 to Hv 500. In this case, the surface damage resistance and the surface damage generation service life of the rail further improve.

Meanwhile, the hardness of the head surface portion of the rail is preferably obtained by averaging hardness measurement values at a plurality of places in the head surface portion. In addition, when both the average hardness at 20 places of a depth of approximately 2 mm from the head surface and the average hardness at 20 places of a depth of approximately 10 mm from the head surface are Hv 400 to Hv 500, the hardness of the region from the head surface to a depth of at least 10 mm is assumed to be Hv 400 to Hv 500. An example of a hardness measurement method will be described below.

<Example of Method and Conditions for Measuring Hardness of Head Surface Portion of Rail>

Device: Vickers hardness tester (the load was 98 N)

Sampling method for test specimens for measurement: Samples including the head surface portion are cut out from a transverse section of the rail head portion.

Pretreatment: The transverse section is polished using diamond abrasive grains having an average grain size of 1 μm.

Measurement method: Measured according to JIS Z 2244.

Calculation of the average hardness at locations of a depth of 2 mm from the head surface: Hardness is measured at arbitrary 20 points of a depth of 2 mm from the head surface, and the average value of measurement values is calculated.

Calculation of the average hardness at locations of a depth of 10 mm from the head surface: Hardness is measured at arbitrary 20 points of a depth of 10 mm from the head surface, and the average value of measurement values is calculated.

Calculation of the average hardness of the head surface portion: The average value of the average hardness at locations of a depth of 2 mm from the head surface and the average hardness at locations of a depth of 10 mm from the head surface is calculated.

Meanwhile, in the present embodiment, the "transverse section" refers to a cross section perpendicular to the rail longitudinal direction.

(5) Heat Treatment Conditions for Head Surface

Next, a production method for the above-described rail having excellent wear resistance and surface damage resistance according to the present embodiment will be described.

A production method for a rail according to the present embodiment includes hot-rolling a bloom or a slab containing the chemical components according to the present embodiment in a rail shape to obtain a material rail, 1st-accelerated-cooling the head surface of the material rail from a temperature region of 700° C. or higher which is a temperature region that is equal to or higher than a transformation start temperature from austenite to a temperature region of 600° C. to 650° C. at a cooling rate of 3.0° C./sec to 10.0° C./sec after the hot-rolling, holding a temperature of the head surface of the material rail in the temperature region of 600° C. to 650° C. for 10 sec to 300 sec after the 1 st-accelerated-cooling, further, 2nd-accelerated-cooling the head surface of the material rail from the temperature region of 600° C. to 650° C. to a temperature region of 350° C. to 500° C. at a cooling rate of 3.0° C./sec to 10.0° C./sec after the holding, and naturally-cooling the head surface of the material rail to room temperature after the 2nd-accelerated-cooling. The production method for a rail according to the present embodiment may further include preliminarily-cooling the hot-rolled rail and then reheating the head surface of the material rail to an austenite transformation completion temperature+30° C. or higher between the hot-rolling and the 1 st-accelerated-cooling.

The material rail refers to a bloom or a slab after hot-rolling in a rail shape and before finishing a heat treatment for microstructure control. Therefore, the material rail has a structure other than that of the rail according to the present embodiment, but has the same shape as that of the rail according to the present embodiment. That is, the material rail includes a material rail head portion having a top head portion which is a flat region extending toward the top portion of the material rail head portion in a extending direction of the material rail, a side head portion which is a flat region extending toward a side portion of the material rail head portion in the extending direction of the material rail, and a corner head portion which is a region combining a rounded corner portion extending between the top head portion and the side head portion and the upper half of the side head portion, and has a head surface constituted of the surface of the top head portion and the surface of the corner head portion. In the production method for a rail according to the present embodiment, in order to control the structure of the head surface portion of the rail, the temperature of the head surface of the material rail is controlled. The structures of places other than the head surface portion in the rail according to the present embodiment are not particularly limited, and thus, in the production method for a rail according to the present embodiment, it is not necessary to control places other than the head surface of the material rail as described above. The temperature of the head surface of the material rail can be measured using, for example, a radiation-type thermometer.

The transformation start temperature from austenite refers to a temperature at which, when steel in which almost all of the structures are austenite is cooled, austenite begins to transform to structures other than austenite. For example, the transformation start temperature from austenite of hypo-eutectoid steel is an $Ar_3$ point (a temperature at which transformation from austenite to ferrite begins), the transformation start temperature from austenite of hyper-eutectoid steel is an $Ar_{cm}$ point (a temperature at which transformation from austenite to cementite begins), and the transformation start temperature from austenite of eutectoid steel is an $Ar_1$ point (a temperature at which transformation from austenite to ferrite and cementite begins). The transformation start temperature from austenite is influenced by the chemical components of steel, particularly, the amount of C in steel.

The austenite transformation completion temperature refers to a temperature at which almost all of the structures of steel become austenite during the heating of the steel as described above. For example, the austenite transformation completion temperature of hypo-eutectoid steel is the $Ac_3$ point, the austenite transformation completion temperature of hyper-eutectoid steel is the $Ac_{cm}$ point, and the austenite transformation completion temperature of eutectoid steel is the $Ac_1$ point.

Hereinafter, the reasons for limiting the conditions of the respective heat treatments after hot-rolling will be described.

"1 st-Accelerated-Cooling"

The production method for a rail according to the present embodiment includes hot-rolling bloom or slab in a rail shape in order to obtain material rails and accelerated-cooling the material rails which is carried out for microstructure control. The conditions for the hot-rolling are not particularly limited and may be appropriately selected from well-known hot-rolling conditions for rails as long as there are no obstacles to carrying out the subsequent steps. The hot-rolling and the accelerated-cooling are preferably continuously carried out; however, depending on the limitation of production facilities and the like, it is also possible to cool and then reheat the head surface of the hot-rolled material rail before the accelerated-cooling.

The temperature of the head surface of the material rail when the heat treatment (accelerated-cooling) begins needs to be equal to or higher than the transformation start temperature from austenite. In a case in which the temperature of the head surface of the material rail when the heat treatment begins is lower than the transformation start temperature from austenite, there are cases in which required structures of the head surface portion of the rail cannot be obtained. This is assumed to be because structures other than austenite are generated in the head surface portion of the material rail before the start of the accelerated-cooling and these structures remain after the heat treatment.

Meanwhile, the transformation start temperature from austenite significantly varies depending on the amount of carbon in steel as described above. The lower limit of the transformation start temperature from austenite of steel having the chemical components of the rail according to the present embodiment is 700° C. Therefore, in the production method for a rail according to the present embodiment, it is necessary to set the lower limit value of the accelerated-cooling start temperature in the accelerated-cooling to 700° C. or higher.

In a case in which cooling (hereinafter, in some cases, referred to as preliminary cooling) and reheating are carried out between hot-rolling and accelerated-cooling, the conditions for the preliminary cooling of the head surface of the material rail are not limited, but the material rail is preferably preliminarily cooled to room temperature in order to facilitate transportation of rails. In addition, in this case, the head surface of the material rail needs to be reheated until the temperature of the head surface of the material rail reaches the austenite transformation completion temperature+30° C. or higher. In a case in which the temperature of the head surface of the material rail is lower than the austenite transformation completion temperature+30° C. when the reheating ends, there are cases in which required structures of the head surface portion of the rail cannot be obtained. This is assumed to be because structures other than austenite remain in the head surface portion of the material rail when the reheating ends and these structures remain after the reheating.

Meanwhile, in order to limit austenite grains being coarsened (that is, the coarsening of pearlite structures after transformation) during the reheating, it is desirable that the reheating temperature is set to the austenite transformation completion temperature+30° C. or higher and the maximum reheating temperature is controlled to be 1,000° C. or lower.

The head surface of the material rail after the hot-rolling or after the reheating is acceleratively-cooled from a temperature region of 700° C. or higher to a temperature region of 600° C. to 650° C. at a cooling rate of 3.0° C./sec to 10.0° C./sec. First, the reasons for limiting the cooling start temperature of the head surface of the material rail to 700° C. or higher will be described.

<1> Cooling Start Conditions in 1st-Accelerated-Cooling

When the temperature of the head surface of the material rail is lower than 700° C. when the accelerated-cooling begins, pearlitic transformation begins before the start of the accelerated-cooling or immediately after the start of the accelerated-cooling, and pearlite having a large lamellar spacing are generated, and thus the hardness of pearlite structures is not increased. As a result, the hardness of the head surface portion of the rail lowers, and the surface damage resistance degrades. Therefore, the temperature of the head surface of the material rail when the accelerated-cooling begins is limited to 700° C. or higher. Meanwhile, the accelerated-cooling start temperature of the head surface of the material rail is desirably 720° C. or higher in order to stabilize the heat treatment effects. In addition, in order to improve the hardness and the structures of the inside (region of a depth of more than 10 mm from the head surface) of the rail head portion, the accelerated-cooling start temperature of the head surface of the material rail is more desirably set to 750° C. or higher.

Meanwhile, in a case in which the accelerated-cooling begins without carrying out cooling and reheating after the hot-rolling, the upper limit of the accelerated-cooling start temperature of the head surface of the material rail is not particularly limited. In a case in which the accelerated-cooling begins without carrying out cooling and reheating after the hot-rolling, the temperature of the head surface of the material rail when finish rolling ends often reaches approximately 950° C., and thus the substantial upper limit value of the accelerated-cooling start temperature reaches approximately 900° C. In order to shorten the heat treatment time, the accelerated-cooling start temperature is desirably set to 850° C. or lower.

In a case in which the head surface of the hot-rolled material rail is cooled and reheated, in order to shorten the heat treatment time, the accelerated-cooling start temperature of the head surface of the material rail is desirably set to 850° C. or lower.

The transformation start temperature from austenite and the austenite transformation completion temperature vary depending on the amount of carbon and the chemical components of steel. In order to accurately obtain the transformation start temperature from austenite and the austenite transformation completion temperature, verification by means of tests is required. However, the transformation start temperature from austenite and the austenite transformation completion temperature may be assumed on the basis of only the amount of carbon in steel from the Fe—$Fe_3C$-based equilibrium diagram described in metallurgy textbooks (for example, "Iron and Steel Materials", The Japan Institute of Metals and Materials). The transformation start temperature from austenite of the rail according to the present embodiment is generally in a range of 700° C. to 800° C.

<2> Accelerated-Cooling Rates in 1st-Accelerated-Cooling

The reasons for limiting the cooling rate in the accelerated-cooling of the head surface of the material rail from a temperature region of 700° C. or higher to 3.0° C./sec to 10.0° C./sec will be described.

When the head surface of the material rail is acceleratively-cooled at a cooling rate of slower than 3.0° C./sec, the cooling rate is slow, and thus pearlitic transformation begins in a high-temperature region immediately after the start of the accelerated-cooling (a temperature region immediately below the transformation start temperature from austenite), and it is not possible to sufficiently increase the hardness of pearlite structures. As a result, the hardness of the head surface portion of the rail decreases, and the surface damage resistance degrades. In addition, when the head surface of the material rail is acceleratively-cooled at a cooling rate of faster than 10.0° C./sec, the amount of heart recovery after the accelerated-cooling increases, and it becomes difficult to hold the head surface in a predetermined temperature range after the accelerated-cooling. As a result, the pearlitic transformation temperature in the holding increases, the control of the hardness of pearlite structures becomes difficult, the hardness of the head surface portion of the rail decreases, and the surface damage resistance degrades. Therefore, the cooling rate from a temperature region of 700° C. or higher is limited to a range of 3.0° C./sec to 10.0° C./sec. Meanwhile, in order to stably control the hardness of pearlite structures and sufficiently increase the hardness of pearlite structures, it is desirable to set the range of the accelerated-cooling rate from a temperature region of 700° C. or higher to 5.0° C./sec to 8.0° C./sec.

<3> Stoppage Temperature Range of Accelerated-Cooling of Head Surface of Material Rail from Temperature Region of 700° C. or Higher in 1st-Accelerated-Cooling It is necessary to control the hardness of the head surface portion of the rail according to the present embodiment to be Hv 400 to Hv 500. In order to obtain the head surface portion having hardness of Hv 400 to Hv 500, it is necessary to appropriately control the hardness of both pearlite and bainite in the head surface portion. Among pearlite and bainite in the head surface portion, the hardness of pearlite is affected by the accelerated-cooling stoppage temperature in the 1st-accelerated-cooling. In the production method of a rail according to the present embodiment, in order to appropriately control the hardness of pearlite structures in the mixed structures, it is necessary to set the cooling stoppage temperature in the 1st-accelerated-cooling to a temperature of 600° C. to 650° C.

If the accelerated-cooling is stopped when the temperature of the head surface of the material rail is within a temperature range which exceeds 650° C., pearlitic transformation begins in a high-temperature region near the cooling stoppage temperature region (a temperature region immediately below the transformation start temperature from austenite), and it is not possible to sufficiently increase the hardness of pearlite structures. As a result, the hardness of the head surface portion of the rail decreases, and the surface damage resistance degrades. In addition, when the accelerated-cooling is stopped when the temperature of the head surface of the material rail is within a temperature range which is lower than 600° C., the rate of pearlitic transformation becomes significantly slow, and pearlite structures are not sufficiently generated. As a result, the amount of bainite structures increases, and the wear resistance of the head surface portion of the rail degrades. Therefore, the accelerated-cooling stoppage temperature of the head surface of the material rail from 700° C. or higher (the stoppage temperature in the 1st-accelerated-cooling) is limited to a temperature of 600° C. to 650° C.

Meanwhile, in a case in which the accelerated-cooling stoppage temperature in the 1st-accelerated-cooling is in a range of 630° C. to 650° C., the hardness of pearlite structures decreases. In this case, in order to control the hardness of the head surface portion of the rail constituted of the mixed structures of pearlite and bainite to Hv 400 to Hv 500, the hardness of bainite structures is preferably increased by setting the accelerated-cooling stoppage temperature in a 2nd-accelerated-cooling described below to a range of 350° C. to 420° C.

In addition, in a case in which the accelerated-cooling stoppage temperature in the 1st-accelerated-cooling is 600° C. or higher and lower than 630° C., the hardness of pearlite structures increases. In this case, in order to control the hardness of the head surface portion of the rail constituted of the mixed structures of pearlite and bainite to Hv 400 to Hv 500, the hardness of bainite structures is preferably decreased by setting the accelerated-cooling stoppage temperature in the 2nd-accelerated-cooling described below to a range of higher than 420° C. and 500° C. or lower. In order to stably control the hardness of pearlite structures, the accelerated-cooling stoppage temperature of the head surface of the material rail from 700° C. or higher (the stoppage temperature in the 1st-accelerated-cooling) is desirably set within a range of 610° C. to 640° C.

"Holding"

In the production method for a rail according to the present embodiment, the above-described accelerated-cooling (the 1st-accelerated-cooling) of the head surface of the material rail from the temperature region of 700° C. or higher to the temperature region of 600° C. to 650° C. (the accelerated-cooling stoppage temperature region) is followed by holding the temperature of the head surface of the material rail within the accelerated-cooling stoppage temperature region for 10 sec to 300 sec.

<4> Holding Time of Temperature of Head Surface of Material Rail in Holding

The reasons for limiting the holding time, when the temperature of the head surface of the material rail is held in the temperature range of 600° C. to 650° C. after the accelerated-cooling (the 1st-accelerated-cooling) of the head surface of the material rail from 700° C. or higher is stopped in a range of 600° C. to 650° C., for 10 sec to 300 sec will be described.

In the head surface portion of the rail according to the present embodiment, it is necessary to control the area ratio of bainite structures to be 20% by area or more and less than 50% by area. In order to obtain the head surface portion having 20% by area or more and less than 50% by area of bainite, it is necessary to generate an appropriate amount of pearlite structures in the holding. Since pearlite structures are first generated, and then bainite structures are generated in the holding, the amount of bainite structures is determined by the amount of pearlite structures. In order to optimize the amount of pearlite structures, it is necessary to control the holding time in the holding to be in an optimal range.

When the holding time is shorter than 10 sec, pearlitic transformation does not sufficiently proceed, the amount of pearlite structures in the head surface of the material rail is insufficient, and it becomes difficult to control the area ratio of the mixed structures in the head surface portion of the rail to be in a predetermined range. As a result, the generation amount of bainite structures excessively increases, and the wear resistance of the head surface portion of the rail degrades. In addition, when the holding time exceeds 300 sec, pearlitic transformation excessively proceeds, the area ratio of pearlite structures exceeds 80% by area, and it becomes difficult to ensure a required amount of bainite. Furthermore, when the holding time exceeds 300 sec, pearlite structures themselves are tempered, and it becomes difficult to ensure the hardness of the head surface portion of the rail. As a result, rolling contact fatigue damage is generated, and the surface damage resistance of the head surface portion of the rail degrades.

Therefore, the holding time of the temperature of the head surface of the material rail in the temperature range of 600° C. to 650° C. after the accelerated-cooling of the head surface of the material rail from 700° C. or higher is stopped is limited to 10 sec or longer and 300 sec or shorter. Meanwhile, in order to sufficiently generate pearlite structures, the holding time is desirably set to 20 sec or longer and more desirably set to 30 sec or longer. In addition, in order to stabilize the area ratio and the hardness of the mixed structures to be in a regulated range, the holding time is desirably set to 250 sec or shorter and more desirably set to 200 sec or shorter.

Meanwhile, in the temperature holding after the accelerated-cooling, it is possible to control pearlite structures by selecting any temperature in the range of the above-described accelerated-cooling stoppage temperature. Therefore, the temperature may be held to be constant during temperature holding, or the temperature may be irregularly fluctuated in the above-described temperature range.

"2nd-Accelerated-Cooling"

In the production method for a rail according to the present embodiment, after the temperature of the head surface of the material rail is held at a holding temperature in a range of 600° C. to 650° C. for 10 sec to 300 sec, the head surface of the material rail is cooled from the holding temperature to a range of 350° C. to 500° C. at an accelerated-cooling rate of 3.0° C./sec to 10.0° C./sec (2nd-accelerated-cooling). In this 2nd-accelerated-cooling, the reasons for limiting the cooling rate to a range of 3.0° C./sec to 10.0° C./sec will be described.

<5> Accelerated-Cooling Rate in 2nd-Accelerated-Cooling

When the head surface of the material rail is acceleratively-cooled at a cooling rate of slower than 3.0° C./sec after the holding, pearlitic transformation begins again in the temperature region immediately after the start of the accelerated-cooling (near 600° C. to 650° C. which is the cooling start temperature), and it is not possible to control the area ratio of the mixed structures in the head surface portion of the rail to be in a predetermined range. In addition, when the head surface of the material rail is acceleratively-cooled at a cooling rate of slower than 3.0° C./sec, bainitic transformation begins at a high temperature, and it is not possible to sufficiently increase the hardness of bainite structures after the accelerated-cooling. As a result, the surface damage resistance of the head surface portion of the rail degrades. In addition, when the head surface of the material rail is cooled at a cooling rate of faster than 10° C./sec, the amount of heart recovery after the accelerated-cooling is increased, the bainitic transformation temperature after the stoppage of the accelerated-cooling is increased, and it becomes difficult to control the hardness of bainite structures. As a result, the hardness of the head surface portion of the rail decreases, and the surface damage resistance degrades. Therefore, the accelerated-cooling rate of the head surface of the material rail from a temperature region of 600° C. to 650° C. is limited to a range of 3.0° C./sec to 10.0° C./sec.

Meanwhile, in order to stably control the hardness of bainite structures and increase the hardness of bainite structures, the accelerated-cooling rate of the head surface of the material rail from a temperature region of 600° C. to 650° C. is desirably set to 5.0° C./sec to 8.0° C./sec.

<6> Accelerated-Cooling Stoppage Temperature Range in 2nd-Accelerated-Cooling

The reasons for limiting the accelerated-cooling stoppage temperature of the head surface of the material rail in the 2nd-accelerated-cooling to a range of 350° C. to 500° C. will be described. As described above, it is necessary to control the hardness of the head surface portion of the rail according to the present embodiment to be Hv 400 to Hv 500. In order to obtain the head surface portion having hardness of Hv 400 to Hv 500, the hardness of both pearlite and bainite in the head surface portion is preferably appropriately controlled. Between pearlite and bainite in the head surface portion, the hardness of bainite is affected by the accelerated-cooling stoppage temperature in the 2nd-accelerated-cooling.

When the accelerated-cooling is stopped in a temperature range above 500° C., the bainitic transformation temperature is increased, and the hardness of bainite structures decreases. As a result, the hardness of the head surface portion of the rail decreases, and the surface damage resistance degrades. In addition, when the head surface of the material rail is acceleratively-cooled from the temperature region of 600° C. to 650° C. to lower than 350° C., the bainitic transformation temperature is lowered, and the hardness of bainite structures excessively increases. In addition, in this case, the bainitic transformation rate is decreased, and martensite structures are generated before bainitic transformation completely ends. As a result, wear resistance degrades due to the generation of martensite structures of the head surface portion of the rail. Furthermore, rolling contact fatigue damage is generated due to an excessive increase in the hardness of the head surface portion of the rail, and the surface damage resistance of the head surface portion of the rail degrades. Therefore, the stoppage temperature of the accelerated-cooling of the head surface of the material rail from a temperature region of 600° C. to 650° C. is limited to a range of 350° C. to 500° C. In the production method for a rail according to the present embodiment, in order to appropriately control the hardness of bainite in the mixed structures, the cooling stoppage temperature in the 2nd-accelerated-cooling is preferably set to 380° C. to 470° C.

Meanwhile, as described above, in a case in which the accelerated-cooling stoppage temperature in the 1st-accelerated-cooling is in a range of 630° C. to 650° C., the hardness of pearlite structures decreases. In this case, in order to control the hardness of the head surface portion of the rail constituted of the mixed structures of pearlite and bainite to be Hv 400 to Hv 500, it is preferable to set the accelerated-cooling stoppage temperature in the 2nd-accelerated-cooling to a range of 350° C. or higher and lower than 420° C., thereby increasing the hardness of bainite structures. In addition, in a case in which the accelerated-cooling stoppage temperature in the 1st-accelerated-cooling is in a range of 600° C. or higher and lower than 630° C., the hardness of pearlite structures increases. In this case, in order to control the hardness of the head surface portion of the rail constituted of the mixed structures of pearlite and bainite to be Hv 400 to Hv 500, it is preferable to set the accelerated-cooling stoppage temperature in the 2nd-accelerated-cooling to a range of higher than 420° C. and 500° C. or lower, thereby decreasing the hardness of bainite structures. In order to stably control the hardness of bainite structures, the accelerated-cooling stoppage temperature (the stoppage temperature of the 2nd-accelerated-cooling) is desirably set to 380° C. to 450° C.

"Naturally-Cooling"

It is possible to control the hardness and area ratio of bainite structures and stably form predetermined mixed structures by naturally-cooling the head surface of the material rail after the 2nd-accelerated-cooling.

When the above-described production conditions (heat treatment conditions) are employed, it is possible to produce the rail according to the present embodiment.

In the production method of a rail according to the present embodiment, the "cooling rate" refers to a value obtained by dividing the difference between the cooling start temperature and the cooling end temperature by the cooling time.

In the production method of a rail according to the present embodiment, in order to generate mixed structures having a predetermined constitution in the head surface portion of the rail requiring surface damage resistance and wear resistance, the production conditions are limited. That is, there are no limitations regarding structures in portions other than the head surface portion (for example, the foot portion and the like of the rail) in which surface damage resistance and wear resistance are not essential. Therefore, in heat treatments in which the cooling conditions of the head surface of the material rail are regulated, the production conditions (heat treatment conditions) of portions other than the head surface of the material rail are not limited. Therefore, portions other than the head surface of the material rail may not be cooled under the above-described cooling conditions.

EXAMPLES

Next, examples of the present invention will be described. Meanwhile, conditions in the present examples are examples of conditions employed to confirm the feasibility and effects of the present invention, and the present invention is not limited to these condition examples. The present invention is allowed to employ a variety of conditions within the scope of the gist of the present invention as long as the object of the present invention is achieved.

Example 1

Tables 1 and 2 show the chemical components of rails (examples, Steels No. A1 to A46) in the scope of the present invention. Table 3 shows the chemical components of rails (comparative examples, Steels No. B1 to B12) outside the scope of the present invention. Underlined values in the tables indicate numeric values outside the ranges regulated in the present invention.

Figure 8:
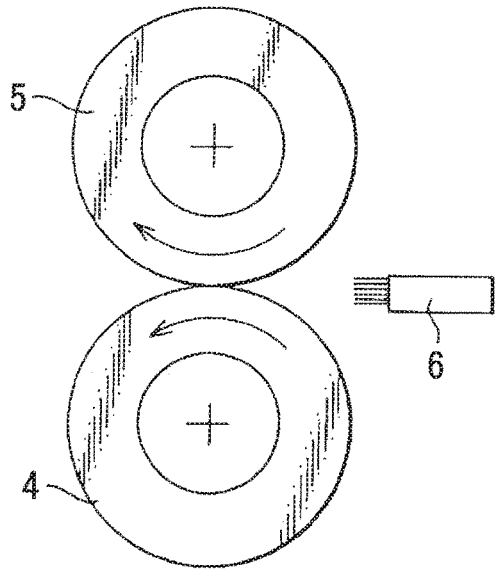
FIG. 8 is a schematic side view showing an outline of the wear test (Nishihara-type wear tester).
Figure 9:
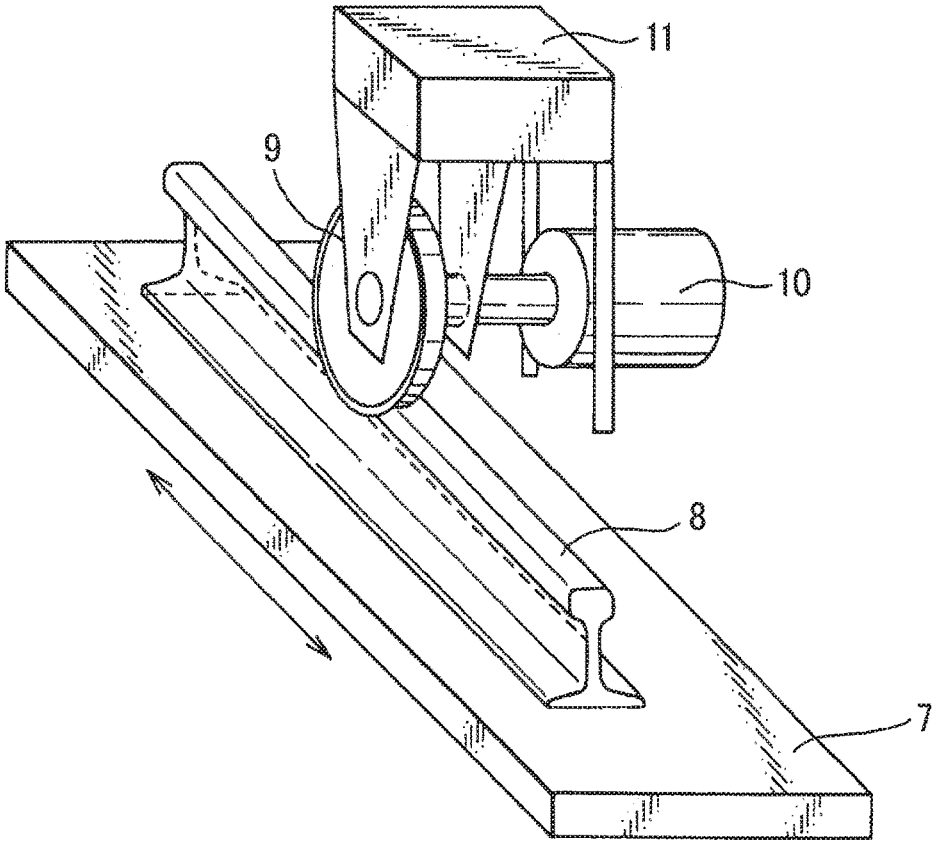
FIG. 9 is a schematic perspective view showing an outline of a rolling contact fatigue test.
Figure 10:
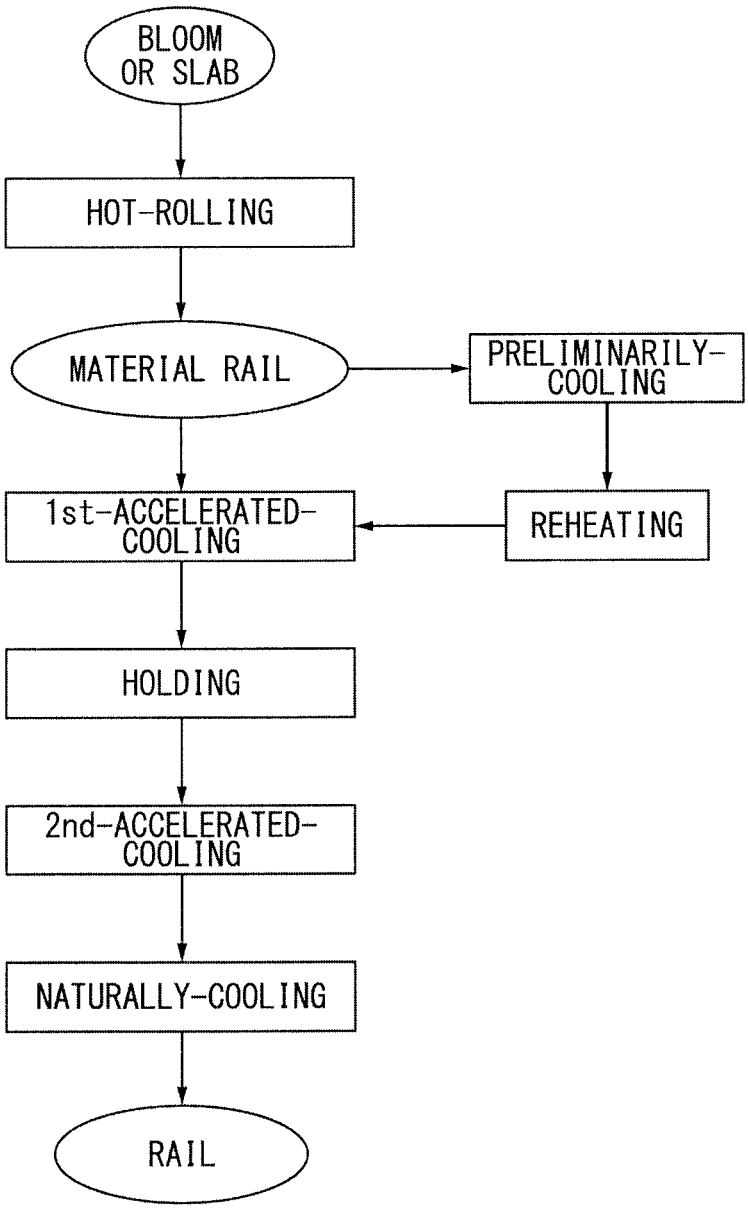
FIG. 10 is a flowchart of a production method for a rail according to another aspect of the present invention.

In addition, Tables 4 to 6 show various characteristics (structures at places of a depth of 2 mm from the head surface and at places of a depth of 10 mm from the head surface, the total amounts of pearlite structures and bainite structures in the head surface portions, hardness at places of a depth of 2 mm from the head surface and at places of a depth of 10 mm from the head surface, the results of wear tests repeated 500,000 times using a method shown in FIG. 8, and the results of rolling contact fatigue tests repeated a maximum of 1.4 million times using a method shown in FIG. 9) of the rails shown in Tables 1 to 3 (Steels No. A1 to A46 and Steels No. B1 to B12).

Figure 7:
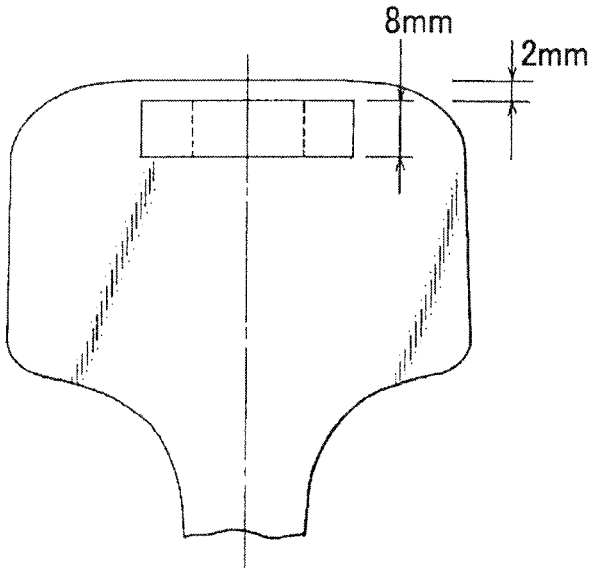
FIG. 7 is a schematic cross sectional view of a rail head portion for describing a sampling location of a cylindarical test specimen for carrying out a wear test.

Meanwhile, FIG. 7 is a cross-sectional view of a rail and shows a sampling location of test specimens used in wear tests shown in FIG. 8. As shown in FIG. 7, 8 mm-thick cylindarical test specimens were cut out from the head surface portions of test rails so that the upper surfaces of the cylindarical test specimens were located 2 mm below the head surfaces of the test rails and the lower surfaces of the cylindarical test specimens were located 10 mm below the head surfaces of the test rails.

In the tables, in places where metallographic structures are disclosed, bainite is represented by "B", pearlite is represented by "P", martensite is represented by "M", and pro-eutectoid ferrite is represented by "F". In places where metallographic structures are disclosed, the amounts of bainite structures are further provided.

In the tables, the hardness at places of a depth of 2 mm below the surface of the head surface portion and places of a depth of 10 mm below the surface is indicated in the unit of Hv. Examples in which hardness at places of a depth of 2 mm below the surface of the head surface portion and hardness at places of a depth of 10 mm below the surface of the head surface portion are both Hv 400 to Hv 500 are considered to be examples in which hardness is within the regulation range of the present invention.

In the tables, the results of wear tests (wear amounts after the end of wear tests repeated 500,000 times) are indicated in the unit of g.

In the tables, the results of rolling contact fatigue tests (the number of repetitions until fatigue damage is generated in rolling contact fatigue tests repeated a maximum of 1.4 million times) are indicated in the unit of 10,000 times. Examples in which the results of rolling contact fatigue tests are described as "–" were examples in which, when rolling contact fatigue tests having a maximum repeat count of 1.4 million times end, fatigue damage is not generated and fatigue damage resistance is favorable.

<Method for Carrying Out Wear Tests for Steels No. A1 to A46 and Steels No. B1 to B12 and Acceptance Criteria>

Tester: Nishihara-type wear tester (see the drawing)

Test specimen shape: Cylindarical test specimen (outer diameter: 30 mm, thickness: 8 mm), a rail material 4 in the drawing Test specimen-sampling location: 2 mm below the head surfaces of rails (see FIG. 7)

Contact surface pressure: 840 MPa

Slip ratio: 9%

Opposite material: Pearlite steel (Hv 380), a wheel material 5 in the drawing Test atmosphere: Air atmosphere Cooling method: Forced cooling using compressed air in which a cooling air nozzle 6 in the drawing was used (flow rate: 100 Nl/min).

The number of repetitions: 500,000 times

Acceptance criteria: Examples in which the wear amounts were 0.6 g or more were considered to be examples in which the wear resistance was outside the regulation range of the present invention.

<Method for Carrying Out Rolling Contact Fatigue Tests for Steels No. A1 to A46 and Steels No. B1 to B12 and Acceptance Criteria>

Tester: A rolling contact fatigue tester (see the drawing)

Test specimen shape: A rail (2 m 141 pound rail), a rail 8 in the drawing

Wheel: Association of American Railroads (AAR)-type (diameter: 920 mm), a wheel 9 in the drawing Radial load and Thrust load: 50 kN to 300 kN, and 100 kN, respectively Lubricant: Dry+oil (intermittent oil supply)

The number of times of rolling: Until damage was generated (in a case in which damage was not generated, a maximum of 1.4 million times)

Acceptance criteria: Examples in which surface damage was generated during rolling contact fatigue tests were considered to be examples of which the fatigue damage resistance was outside the regulation range of the present invention.

<Hardness Measurement Method for Steels No. A1 to A46 and Steels No. B1 to B12>

Test specimens for measurement: Test specimens cut out from transverse sections of rail head portions including head surface portions Pretreatment: Cross sections were diamond-polished.

Device: A Vickers hardness tester was used (the load was 98 N).

Measurement method: According to JIS Z 2244

Measurement method of hardness at locations of depth of 2 mm from the head surfaces: Hardness at arbitrary 20 places at depth of 2 mm from the head surfaces was measured, and the hardness values were averaged, thereby obtaining the hardness.

Measurement method of hardness at locations of depth of 10 mm from the head surfaces: Hardness at arbitrary 20 places at depth of 10 mm from the head surfaces was measured, and the hardness values were averaged, thereby obtaining the hardness.

<Structure Observation Method for Steels No. A1 to A46 and Steels No. B1 to B12>

Pretreatment: Cross sections were diamond-polished, and then were etched using 3% Nital.

Structure observation: An optical microscope was used.

Measurement method of bainite area ratios in regions from head surface to depth of 10 mm: The bainite area ratios at 20 places at depth of 2 mm from the head surfaces and the bainite area ratios at 20 places at depth of 10 mm from the head surfaces were obtained on the basis of optical microscopic photographs respectively, and the area ratios were averaged, thereby obtaining the values at the respective locations.

The outline of the manufacturing process and the production conditions of rails of examples and comparative examples shown in Tables 4 to 6 is as described below. Meanwhile, in all of the examples, rails were naturally-cooled (air-cooled) after the 2nd-accelerated-cooling.

<Outline of Manufacturing Process>

Production method 1 (abbreviated as "<1>" in the tables): The chemical components of molten steel were adjusted and molten steel were cast, and blooms or slabs were reheated in a temperature range of 1,250° C. to 1,300° C., were hot-rolled, and were heat-treated.

Production method 2 (abbreviated as "<2>" in the tables): The chemical components of molten steel were adjusted and molten steel were cast, blooms or slabs were reheated in a temperature range of 1,250° C. to 1,300° C., were hot-rolled, and were, first, preliminarily cooled to normal temperature, thereby producing material rails, and then head surfaces were reheated to the austenite transformation completion temperature+30° C. or higher and were heat-treated.

<Head Surface Portion Heat Treatment Conditions>

"1st-Accelerated-Cooling"

Cooling start temperature: 750° C.

Accelerated-cooling rate: 5.0° C./sec

Accelerated-cooling stoppage temperature: 620° C.

"Holding"

Holding time: 150 sec

"2nd-Accelerated-Cooling"

Accelerated-cooling rate: 5.0° C./sec

Accelerated-cooling stoppage temperature: 430° C.

The details of rails of examples and comparative examples shown in Tables 1 to 3 will be as described below.

(1) Invention Rails (46 Rails)

Symbols A1 to A46: Rails in which the chemical component values, structures in the head surface portions, and the hardness of the head surface portions were within the scope of the present invention.

(2) Comparative Rails (12 Rails)

Symbols B1 to B12 (12 rails): Rails in which the amounts of C, Si, Mn, Cr, P, and S were outside the scope of the present invention.

TABLE 1

| | STEEL | CHEMICAL COMPONENTS (mass %) | | | | | | | | | | | | | | | | | |
|---|---|---|---|---|---|---|---|---|---|---|---|---|---|---|---|---|---|---|---|
| | No. | C | Si | Mn | Cr | P | S | Mo | Co | Cu | Ni | V | Nb | Mg | Ca | REM | B | Zr | N |
| INVENTIVE EXAMPLES | A1 | 0.70 | 0.30 | 0.55 | 0.60 | 0.0120 | 0.0110 | — | — | — | — | — | — | — | — | — | — | — | — |
| | A2 | 1.00 | 0.30 | 0.55 | 0.60 | 0.0120 | 0.0110 | — | — | — | — | — | — | — | — | — | — | — | — |
| | A3 | 0.85 | 0.20 | 0.35 | 0.75 | 0.0180 | 0.0150 | — | — | — | — | — | — | — | — | — | — | — | — |
| | A4 | 0.85 | 1.50 | 0.35 | 0.75 | 0.0180 | 0.0150 | — | — | — | — | — | — | — | — | — | — | — | — |
| | A5 | 0.75 | 0.25 | 0.20 | 0.90 | 0.0150 | 0.0080 | — | — | — | — | — | — | — | — | — | — | — | — |
| | A6 | 0.75 | 0.25 | 1.00 | 0.90 | 0.0150 | 0.0080 | — | — | — | — | — | — | — | — | — | — | — | — |
| | A7 | 0.83 | 0.45 | 0.50 | 0.40 | 0.0150 | 0.0080 | — | — | — | — | — | — | — | — | — | — | — | — |
| | A8 | 0.83 | 0.45 | 0.50 | 1.20 | 0.0150 | 0.0080 | — | — | — | — | — | — | — | — | — | — | — | — |
| | A9 | 0.80 | 0.60 | 1.00 | 1.00 | 0.0250 | 0.0100 | — | — | — | — | — | — | — | — | — | — | — | — |
| | A10 | 0.80 | 0.25 | 1.00 | 0.50 | 0.0150 | 0.0250 | — | — | — | — | — | — | — | — | — | — | — | — |
| | A11 | 0.70 | 0.25 | 0.85 | 0.90 | 0.0120 | 0.0100 | — | — | — | — | — | — | — | — | — | — | — | — |
| | A12 | 0.70 | 0.25 | 0.85 | 0.90 | 0.0120 | 0.0100 | 0.02 | — | — | — | — | — | — | — | — | — | — | — |
| | A13 | 0.72 | 0.55 | 0.70 | 1.05 | 0.0120 | 0.0100 | — | — | — | — | — | — | — | — | — | — | — | — |
| | A14 | 0.72 | 0.55 | 0.70 | 1.05 | 0.0120 | 0.0100 | — | 0.10 | — | — | — | — | — | — | — | — | — | — |
| | A15 | 0.75 | 0.20 | 1.00 | 0.70 | 0.0150 | 0.0090 | — | — | — | — | — | — | — | — | — | — | — | — |
| | A16 | 0.75 | 0.20 | 1.00 | 0.70 | 0.0150 | 0.0090 | — | — | — | — | 0.05 | — | — | — | — | — | — | — |
| | A17 | 0.75 | 0.20 | 1.00 | 0.70 | 0.0150 | 0.0090 | — | — | — | — | 0.10 | — | — | — | — | — | — | — |
| | A18 | 0.77 | 0.80 | 0.70 | 0.80 | 0.0180 | 0.0080 | — | — | — | — | — | — | — | — | — | — | — | — |
| | A19 | 0.77 | 0.80 | 0.80 | 0.55 | 0.0180 | 0.0080 | — | — | — | — | — | — | — | — | — | — | — | — |
| | A20 | 0.77 | 0.80 | 0.70 | 0.80 | 0.0180 | 0.0080 | — | — | — | — | — | — | — | — | — | 0.0010 | — | — |
| | A21 | 0.78 | 0.50 | 0.80 | 1.20 | 0.0110 | 0.0100 | — | — | — | — | — | — | — | — | — | — | — | — |
| | A22 | 0.78 | 0.50 | 0.90 | 0.75 | 0.0110 | 0.0100 | — | — | — | — | — | — | — | — | — | — | — | — |

TABLE 2

| | STEEL | CHEMICAL COMPONENTS (mass %) | | | | | | | | | |
|---|---|---|---|---|---|---|---|---|---|---|---|
| | No. | C | Si | Mn | Cr | P | S | Mo | Co | Cu | Ni |
| INVENTIVE EXAMPLES | A23 | 0.79 | 1.20 | 0.40 | 0.80 | 0.0150 | 0.0210 | — | — | — | — |
| | A24 | 0.79 | 1.20 | 0.40 | 0.80 | 0.0150 | 0.0210 | — | — | — | — |
| | A25 | 0.80 | 0.60 | 0.50 | 0.75 | 0.0150 | 0.0180 | — | — | — | — |
| | A26 | 0.80 | 0.60 | 0.75 | 0.60 | 0.0150 | 0.0180 | — | — | — | — |
| | A27 | 0.80 | 0.60 | 0.50 | 0.75 | 0.0150 | 0.0180 | — | — | — | — |
| | A28 | 0.80 | 0.45 | 0.70 | 1.20 | 0.0100 | 0.0050 | — | — | — | — |
| | A29 | 0.81 | 0.70 | 0.25 | 1.05 | 0.0080 | 0.0070 | — | — | — | — |
| | A30 | 0.81 | 0.70 | 0.25 | 1.05 | 0.0080 | 0.0070 | — | — | — | — |
| | A31 | 0.82 | 0.25 | 0.80 | 1.20 | 0.0150 | 0.0140 | — | — | — | — |
| | A32 | 0.82 | 0.25 | 0.80 | 1.20 | 0.0150 | 0.0140 | — | — | — | — |
| | A33 | 0.82 | 0.45 | 1.00 | 1.10 | 0.0220 | 0.0050 | — | — | — | — |
| | A34 | 0.82 | 0.45 | 1.00 | 0.50 | 0.0220 | 0.0050 | — | — | — | — |
| | A35 | 0.82 | 0.45 | 1.00 | 1.10 | 0.0220 | 0.0050 | — | — | 0.10 | — |
| | A36 | 0.85 | 0.55 | 0.35 | 0.40 | 0.0150 | 0.0120 | — | — | — | — |
| | A37 | 0.85 | 0.55 | 0.35 | 0.40 | 0.0150 | 0.0120 | — | — | — | 0.10 |
| | A38 | 0.87 | 0.75 | 0.40 | 0.60 | 0.0070 | 0.0080 | — | — | — | — |
| | A39 | 0.87 | 0.75 | 0.40 | 0.60 | 0.0070 | 0.0080 | — | — | — | — |
| | A40 | 0.90 | 0.50 | 0.30 | 0.80 | 0.0150 | 0.0140 | — | — | — | — |
| | A41 | 0.90 | 0.50 | 0.80 | 0.35 | 0.0150 | 0.0140 | — | — | — | — |
| | A42 | 0.90 | 0.50 | 0.30 | 0.80 | 0.0150 | 0.0140 | 0.02 | — | — | — |
| | A43 | 0.92 | 0.75 | 0.60 | 0.40 | 0.0070 | 0.0080 | — | — | — | — |
| | A44 | 0.95 | 0.50 | 0.80 | 0.30 | 0.0150 | 0.0140 | — | — | — | — |
| | A45 | 0.95 | 0.50 | 0.80 | 0.30 | 0.0150 | 0.0140 | — | — | — | — |
| | A46 | 1.00 | 0.50 | 0.80 | 0.60 | 0.0150 | 0.0140 | — | — | — | — |

| | STEEL | CHEMICAL COMPONENTS (mass %) | | | | | | | |
|---|---|---|---|---|---|---|---|---|---|
| | No. | V | Nb | Mg | Ca | REM | B | Zr | N |
| INVENTIVE EXAMPLES | A23 | — | — | — | — | — | — | — | — |
| | A24 | — | — | 0.0025 | 0.0015 | — | — | — | — |
| | A25 | — | — | — | — | — | — | — | — |
| | A26 | — | — | — | — | — | — | — | — |
| | A27 | 0.05 | — | — | — | — | — | — | 0.0140 |
| | A28 | — | — | — | — | — | — | — | — |
| | A29 | — | — | — | — | — | — | — | — |
| | A30 | — | — | — | — | — | — | 0.0012 | — |
| | A31 | — | — | — | — | — | — | — | — |
| | A32 | — | — | — | — | 0.0025 | — | — | — |
| | A33 | — | — | — | — | — | — | — | — |
| | A34 | — | — | — | — | — | — | — | — |
| | A35 | — | — | — | — | — | — | — | — |
| | A36 | — | — | — | — | — | — | — | — |
| | A37 | — | — | — | — | — | — | — | — |
| | A38 | — | — | — | — | — | — | — | — |
| | A39 | 0.08 | — | — | — | — | — | — | — |
| | A40 | — | — | — | — | — | — | — | — |
| | A41 | — | — | — | — | — | — | — | — |
| | A42 | — | — | — | — | — | 0.0010 | — | — |
| | A43 | — | — | — | — | — | — | — | — |
| | A44 | — | — | — | — | — | — | — | — |
| | A45 | — | 0.0025 | — | — | — | — | — | — |
| | A46 | — | — | — | — | — | 0.0010 | — | — |

TABLE 3

| | STEEL | CHEMICAL COMPONENTS (mass %) | | | | | | | | | | | | | | | | | |
|---|---|---|---|---|---|---|---|---|---|---|---|---|---|---|---|---|---|---|---|
| | NO. | C | Si | Mn | Cr | P | S | Mo | Co | Cu | Ni | V | Nb | Mg | Ca | REM | B | Zr | N |
| COMPARATIVE EXAMPLES | B1 | 0.60 | 0.30 | 0.55 | 0.60 | 0.0120 | 0.0110 | — | — | — | — | — | — | — | — | — | — | — | — |
| | B2 | 1.10 | 0.30 | 0.55 | 0.60 | 0.0120 | 0.0110 | — | — | — | — | — | — | — | — | — | — | — | — |
| | B3 | 0.85 | 0.10 | 0.35 | 0.75 | 0.0180 | 0.0150 | — | — | — | — | — | — | — | — | — | — | — | — |
| | B4 | 0.85 | 2.00 | 0.35 | 0.75 | 0.0180 | 0.0150 | — | — | — | — | — | — | — | — | — | — | — | — |
| | B5 | 0.75 | 0.25 | 0.10 | 0.90 | 0.0150 | 0.0080 | — | — | — | — | — | — | — | — | — | — | — | — |
| | B6 | 0.75 | 0.25 | 1.15 | 0.90 | 0.0150 | 0.0080 | — | — | — | — | — | — | — | — | — | — | — | — |
| | B7 | 0.75 | 0.25 | 2.25 | 0.90 | 0.0150 | 0.0080 | — | — | — | — | — | — | — | — | — | — | — | — |
| | B8 | 0.83 | 0.45 | 0.50 | 0.10 | 0.0150 | 0.0080 | — | — | — | — | — | — | — | — | — | — | — | — |
| | B9 | 0.83 | 0.45 | 0.50 | 1.30 | 0.0150 | 0.0080 | — | — | — | — | — | — | — | — | — | — | — | — |
| | B10 | 0.83 | 0.45 | 0.50 | 2.00 | 0.0150 | 0.0080 | — | — | — | — | — | — | — | — | — | — | — | — |
| | B11 | 0.80 | 0.60 | 1.00 | 1.00 | 0.0300 | 0.0100 | — | — | — | — | — | — | — | — | — | — | — | — |
| | B12 | 0.80 | 0.25 | 1.00 | 0.50 | 0.0150 | 0.0350 | — | — | — | — | — | — | — | — | — | — | — | — |

TABLE 4

| | STEEL No. | STRUCTURE OF HEAD SURFACE PORTION: 2 mm BELOW HEAD SURFACE | STRUCTURE OF HEAD SURFACE PORTION: 10 mm BELOW HEAD SURFACE | TOTAL: AMOUNT OF PEARLITE AND BAINITE (area %) | HARDNESS OF HEAD SURFACE PORTION (Hv): 2 mm BELOW HEAD SURFACE | HARDNESS OF HEAD SURFACE PORTION (Hv): 10 mm BELOW HEAD SURFACE | RESULTS OF WEAR: TEST WEAR AMOUNT (g) | RESULTS OF ROLLING CONTACT FATIGUE TEST NUMBER UNTIL: FATIGUE DAMAGE IS GENERATED (TEN THOUSAND TIMES) | PRODUCTION METHOD |
|---|---|---|---|---|---|---|---|---|---|
| INVENTIVE EXAMPLES | A1 | P + B (25%) | P + B (25%) | 96 | 415 | 400 | 0.55 | — | <1> |
| | A2 | P + B (20%) | P + B (20%) | 95 | 445 | 423 | 0.20 | — | <1> |
| | A3 | P + B (35%) | P + B (35%) | 95 | 435 | 412 | 0.40 | — | <1> |
| | A4 | P + B (35%) | P + B (35%) | 95 | 460 | 435 | 0.37 | — | <1> |
| | A5 | P + B (25%) | P + B (20%) | 100 | 420 | 405 | 0.38 | — | <1> |
| | A6 | P + B (35%) | P + B (35%) | 99 | 450 | 435 | 0.40 | — | <1> |
| | A7 | P + B (20%) | P + B (20%) | 98 | 420 | 405 | 0.38 | — | <2> |
| | A8 | P + B (45%) | P + B (40%) | 95 | 465 | 435 | 0.36 | — | <2> |
| | A9 | P + B (49%) | P + B (45%) | 98 | 481 | 449 | 0.34 | — | <1> |
| | A10 | P + B (35%) | P + B (35%) | 97 | 435 | 410 | 0.39 | — | <1> |
| | A11 | P + B (35%) | P + B (25%) | 99 | 435 | 405 | 0.50 | — | <1> |
| | A12 | P + B (40%) | P + B (35%) | 100 | 440 | 410 | 0.48 | — | <1> |
| | A13 | P + B (35%) | P + B (25%) | 96 | 440 | 414 | 0.48 | — | <2> |
| | A14 | P + B (35%) | P + B (25%) | 99 | 440 | 414 | 0.40 | — | <2> |
| | A15 | P + B (25%) | P + B (20%) | 95 | 435 | 410 | 0.42 | — | <1> |
| | A16 | P + B (25%) | P + B (20%) | 95 | 435 | 410 | 0.42 | — | <1> |
| | A17 | P + B (25%) | P + B (20%) | 95 | 435 | 420 | 0.41 | — | <1> |
| | A18 | P + B (35%) | P + B (25%) | 98 | 450 | 425 | 0.39 | — | <1> |
| | A19 | P + B (25%) | P + B (20%) | 99 | 455 | 430 | 0.35 | — | <1> |
| | A20 | P + B (35%) | P + B (35%) | 98 | 455 | 435 | 0.38 | — | <1> |
| | A21 | P + B (40%) | P + B (35%) | 100 | 470 | 445 | 0.36 | — | <1> |
| | A22 | P + B (35%) | P + B (30%) | 98 | 475 | 450 | 0.34 | — | <1> |

TABLE 5

| | STEEL No. | STRUCTURE OF HEAD SURFACE PORTION: 2 mm BELOW HEAD SURFACE | STRUCTURE OF HEAD SURFACE PORTION: 10 mm BELOW HEAD SURFACE | TOTAL: AMOUNT OF PEARLITE AND BAINITE (area %) | HARDNESS OF HEAD SURFACE PORTION (Hv): 2 mm BELOW HEAD SURFACE | HARDNESS OF HEAD SURFACE PORTION (Hv): 10 mm BELOW HEAD SURFACE | RESULTS OF WEAR: TEST WEAR AMOUNT (g) | RESULTS OF ROLLING CONTACT FATIGUE TEST NUMBER UNTIL: FATIGUE DAMAGE IS GENERATED (TEN THOUSAND TIMES) | PRODUCTION METHOD |
|---|---|---|---|---|---|---|---|---|---|
| INVENTIVE EXAMPLES | A23 | P + B (25%) | P + B (20%) | 99 | 440 | 418 | 0.39 | — | <1> |
| | A24 | P + B (25%) | P + B (20%) | 100 | 440 | 418 | 0.39 | — | <1> |
| | A25 | P + B (25%) | P + B (20%) | 96 | 435 | 415 | 0.36 | — | <1> |
| | A26 | P + B (20%) | P + B (20%) | 99 | 440 | 420 | 0.34 | — | <1> |
| | A27 | P + B (25%) | P + B (20%) | 95 | 435 | 425 | 0.37 | — | <1> |
| | A28 | P + B (40%) | P + B (35%) | 95 | 480 | 455 | 0.33 | — | <1> |
| | A29 | P + B (35%) | P + B (35%) | 100 | 455 | 435 | 0.38 | — | <1> |
| | A30 | P + B (35%) | P + B (35%) | 99 | 455 | 435 | 0.38 | — | <1> |
| | A31 | P + B (40%) | P + B (40%) | 98 | 480 | 458 | 0.34 | — | <1> |
| | A32 | P + B (40%) | P + B (40%) | 95 | 480 | 458 | 0.34 | — | <1> |
| | A33 | P + B (48%) | P + B (45%) | 98 | 490 | 452 | 0.39 | — | <2> |
| | A34 | P + B (35%) | P + B (35%) | 99 | 495 | 460 | 0.36 | — | <2> |
| | A35 | P + B (45%) | P + B (45%) | 95 | 498 | 462 | 0.30 | — | <2> |
| | A36 | P + B (25%) | P + B (25%) | 95 | 420 | 400 | 0.37 | — | <2> |
| | A37 | P + B (25%) | P + B (25%) | 95 | 435 | 410 | 0.37 | — | <2> |
| | A38 | P + B (35%) | P + B (25%) | 98 | 445 | 420 | 0.35 | — | <1> |
| | A39 | P + B (35%) | P + B (25%) | 99 | 445 | 435 | 0.35 | — | <1> |
| | A40 | P + B (49%) | P + B (45%) | 100 | 460 | 431 | 0.34 | — | <1> |
| | A41 | P + B (35%) | P + B (35%) | 99 | 475 | 440 | 0.33 | — | <1> |
| | A42 | P + B (45%) | P + B (40%) | 96 | 470 | 439 | 0.33 | — | <1> |
| | A43 | P + B (40%) | P + B (30%) | 95 | 445 | 435 | 0.33 | — | <1> |
| | A44 | P + B (30%) | P + B (30%) | 100 | 460 | 431 | 0.27 | — | <1> |
| | A45 | P + B (30%) | P + B (30%) | 98 | 460 | 445 | 0.27 | — | <1> |
| | A46 | P + B (35%) | P + B (35%) | 97 | 470 | 439 | 0.25 | — | <1> |

TABLE 6

| | STEEL No. | STRUCTURE OF HEAD SURFACE PORTION: 2 mm BELOW HEAD SURFACE | STRUCTURE OF HEAD SURFACE PORTION: 10 mm BELOW HEAD SURFACE | TOTAL: AMOUNT OF PEARLITE AND BAINITE (area %) | HARDNESS OF HEAD SURFACE PORTION (Hv): 2 mm BELOW HEAD SURFACE | HARDNESS OF HEAD SURFACE PORTION (Hv): 10 mm BELOW HEAD SURFACE | RESULTS OF WEAR: TEST WEAR AMOUNT (g) | RESULTS OF ROLLING CONTACT FATIGUE TEST NUMBER UNTIL: FATIGUE DAMAGE IS GENERATED (TEN THOUSAND TIMES) | PRODUCTION METHOD |
|---|---|---|---|---|---|---|---|---|---|
| COMPARATIVE EXAMPLES | B1 | P + B (25%) | P + B (25%) | 96 | 415 | 400 | 1.80 | — | <1> |
| | B2 | P + B (20%) | P + B (20%) | 97 | 440 | 420 | 0.11 | 35 | <1> |
| | B3 | P + B (35%) | P + B (35%) | 95 | 390 | 375 | 0.50 | 95 | <1> |
| | B4 | P +B (20%) +M | P +B (20%) +M | 75 | 532 | 502 | 2.50 | 50 | <1> |
| | B5 | P +B (10%) | P +B (10%) | 95 | 440 | 420 | 0.30 | 50 | <1> |
| | B6 | P +B (30%) +M | P +B (30%) +M | 85 | 530 | 500 | 2.45 | 50 | <1> |
| | B7 | P +B (25%) +M | P +B (25%) +M | 70 | 550 | 512 | 2.62 | 30 | <1> |
| | B8 | P +B (10%) | P +B (10%) | 98 | 450 | 425 | 0.25 | 55 | <2> |
| | B9 | P +B (35%) +M | P +B (35%) +M | 80 | 510 | 495 | 1.95 | 60 | <2> |
| | B10 | P +B (40%) +M | P +B (40%) +M | 60 | 535 | 495 | 2.45 | 45 | <2> |
| | B11 | P + B (49%) | P + B (45%) | 98 | 490 | 445 | 0.34 | 75 | <1> |
| | B12 | P + B (35%) | P + B (35%) | 97 | 435 | 410 | 0.39 | 80 | <1> |

As shown in Tables 1 to 6, compared with the rails of comparative examples (symbols B1 to B12), in the rails of the present examples (symbols A1 to A46) in which the amounts of the respective alloy elements are in the regulation ranges of the present invention, in the head surface portions of the rails, the generation of pro-eutectoid ferrite structures, pro-eutectoid cementite structures, and martensite structures was suppressed, mixed structures of pearlite structures and bainite structures were formed in the head surface portions, and the wear resistance and the surface damage resistance were improved.

In addition, as shown in Tables 1 to 6, compared with the rail steel of comparative examples (symbols B1 to B12), in the rail steel of the present examples (symbols A1 to A46), the components of the steel and the area ratios of bainite structures were controlled, and furthermore, the hardness of the head surface portions of the rails were controlled, whereby the wear resistance and the surface damage resistance were improved.

On the other hand, in Steel B1 in which the amount of C was insufficient, the wear resistance was insufficient.

In Steel B2 in which the amount of C was excessive, the wear resistance was excessively high, and thus the surface damage resistance was insufficient.

In Steel B3 in which Si was insufficient, the hardness was insufficient, and thus the surface damage resistance was insufficient.

In Steel B4 in which Si was excessive, martensite was generated, and thus both the wear resistance and the surface damage resistance were insufficient.

In Steel B5 in which Mn was insufficient, the amount of bainite was insufficient, and thus the surface damage resistance was insufficient.

In Steel B6 and Steel B7 in which Mn was excessive, martensite was generated, and thus both the wear resistance and the surface damage resistance were insufficient.

In Steel B8 in which Cr was insufficient, the amount of bainite was insufficient, and thus the surface damage resistance was insufficient.

In Steel B9 and Steel B10 in which Cr was excessive, martensite was generated, and thus both the wear resistance and the surface damage resistance were insufficient.

In Steel B11 in which P was excessive, embrittlement occurred, and thus the surface damage resistance was insufficient.

In Steel B12 in which S was excessive, the amount of inclusions was increased, and thus the surface damage resistance was insufficient.

Example 2

Next, rails (Nos. C1 to C26) were produced under a variety of production conditions as shown in Table 7 using steel having the same chemical components (all are chemical components in the regulation ranges of the present invention) as those of No. A15, A21, A33, A36, A38, and A40 shown in Tables 1 and 2. Table 7 shows the heat treatment conditions (the cooling start temperatures, the accelerated-cooling rates, and the accelerated-cooling stoppage temperatures in the 1st-accelerated-cooling, the holding times in the holding, and the accelerated-cooling rates and the accelerated-cooling stoppage temperatures in the 2nd-accelerated-cooling) of the head surface portions of Examples No. C1 to C26. In the production of Example C5, the temperature was increased due to heart recovery after the accelerated-cooling in the 1st-accelerated-cooling, and the temperature was not held to be constant, and thus the holding time of Example C5 is not shown in Table 7. In the productions of Example C20 and Example C21, the temperatures were increased due to heart recovery after the accelerated-cooling in the 2nd-accelerated-cooling, and the accelerated-cooling was not stably stopped, and thus the values of the accelerated-cooling stoppage temperatures in Example C20 and Example C21 are underlined and are marked with a symbol "*".

Table 8 shows various characteristics of the respective obtained rails (Nos. C1 to C26). Table 8 shows the structures in the head surface portions, the hardness of the head surface portions, the wear test results, and the rolling contact fatigue test results in the same manner as in Tables 4 to 6. In Table 9, in places where structures are disclosed, numeric values next to a symbol "B" indicate the amounts of bainite.

In addition, the methods for carrying out wear tests and the acceptance criteria, the methods for carrying out rolling contact fatigue tests and the acceptance criteria, the hardness measurement methods for the head surface portions of the rails, and the structure observation methods for Steels No. C1 to C26 were the same as those for Steels No. A1 to A46 and Steels No. B1 to B12.

As shown in Table 8, in Examples C1, C3, C6, C11, C17, and C22 in which the conditions (the cooling start temperatures, the accelerated-cooling rates, and the accelerated-cooling stoppage temperatures) for the 1st-accelerated-cooling, the conditions (the holding times) for the holding, and the conditions (the accelerated-cooling rates and the accelerated-cooling stoppage temperatures) for the 2nd-accelerated-cooling were carried out within the scope of the present invention, structures and hardness were appropriately controlled, and the generation of martensite structures and the like was suppressed, and thus the rails had favorable wear resistance and surface damage resistance.

On the other hand, in Comparative Example C2 in which the cooling start temperature in the 1st-accelerated-cooling was low, the pearlitic transformation temperature was high, and thus the hardness was insufficient, and the surface damage resistance was insufficient.

In Comparative Example C4 in which the accelerated-cooling rate in the 1st-accelerated-cooling was slow, the pearlitic transformation temperature was high, and thus the hardness was insufficient, and the surface damage resistance was insufficient.

In Comparative Example C5 in which the accelerated-cooling rate in the 1st-accelerated-cooling was excessive, the temperature was not appropriately held after the 1st-accelerated-cooling, and thus the pearlitic transformation temperature became high, the hardness was insufficient, and the surface damage resistance was insufficient.

In Comparative Examples C7 and C8 in which the accelerated-cooling stoppage temperatures in the 1st-accelerated-cooling were high, the pearlitic transformation temperatures became high, and thus the hardness was insufficient, and the surface damage resistance was insufficient.

In Comparative Examples C9 and C10 in which the accelerated-cooling stoppage temperatures in the 1st-accelerated-cooling were low, the generation amounts of bainite were excessive, and thus the wear resistance was insufficient.

In Comparative Examples C12 and C13 in which the holding times in the holding were short, the generation amounts of bainite were excessive, and thus the wear resistance was insufficient.

In Comparative Examples C14 to C16 in which the holding times in the holding were long, the generation amounts of bainite were insufficient, and thus the wear resistance was insufficient.

In Comparative Examples C18 and C19 in which the accelerated-cooling rates in the 2nd-accelerated-cooling were slow, the bainitic transformation temperatures were high, and thus the hardness was insufficient, and the surface damage resistance was insufficient. In Comparative Examples C20 and C21 in which the accelerated-cooling rates in the 2nd-accelerated-cooling were excessive, heart recovery occurred after the 2nd-accelerated-cooling, and the accelerated-cooling was not appropriately stopped, and thus the bainitic transformation temperatures became high, the hardness was insufficient, and the surface damage resistance was insufficient.

In Comparative Examples C23 and C24 in which the accelerated-cooling stoppage temperatures in the 2nd-accelerated-cooling were excessively high, the bainitic transformation temperatures were high, and thus the hardness was insufficient, and the surface damage resistance was insufficient.

In Comparative Examples C25 and C26 in which the accelerated-cooling stoppage temperatures in the 2nd-accelerated-cooling were excessively low, martensite was generated, and thus both the surface damage resistance and the wear resistance were insufficient.

TABLE 7

| | | | 1st-ACCELERATED-COOLING | | | HOLD- | 2nd-ACCELERATED-COOLING | |
|---|---|---|---|---|---|---|---|---|
| STEEL No. | EXAMPLE No. | | COOLING START TEMPERATURE (° C.) | ACCELERATED-COOLING RATE (° C./sec) | ACCELERATED-COOLING STOPPAGE TEMPERATURE (° C.) | ING HOLD-ING TIME (sec) | ACCELERATED-COOLING RATE (° C./sec) | ACCELERATED-COOLING STOPPAGE TEMPERATURE (° C.) |
| A36 | C1 | INVENTIVE EXAMPLE | 700 | 5.0 | 620 | 50 | 8.0 | 450 |
| | C2 | COMPARATIVE EXAMPLE | 650 | 5.0 | 620 | 50 | 8.0 | 450 |
| A15 | C3 | INVENTIVE EXAMPLE | 720 | 10.0 | 600 | 100 | 10.0 | 435 |
| | C4 | COMPARATIVE | 720 | 2.0 | 600 | 100 | 10.0 | 435 |
| | C5 | EXAMPLE | 720 | 15.0 | 600 | | 10.0 | 435 |
| A38 | C6 | INVENTIVE EXAMPLE | 700 | 8.0 | 610 | 150 | 3.0 | 470 |
| | C7 | COMPARATIVE | 700 | 8.0 | 660 | 200 | 3.0 | 470 |
| | C8 | EXAMPLE | 700 | 8.0 | 655 | 200 | 3.0 | 470 |
| | C9 | | 700 | 8.0 | 595 | 200 | 3.0 | 470 |
| | C10 | | 700 | 8.0 | 580 | 200 | 3.0 | 470 |
| A21 | C11 | INVENTIVE EXAMPLE | 800 | 3.0 | 610 | 120 | 6.0 | 400 |
| | C12 | COMPARATIVE | 800 | 3.0 | 610 | 5 | 6.0 | 400 |
| | C13 | EXAMPLE | 800 | 3.0 | 610 | 9 | 6.0 | 400 |
| | C14 | | 800 | 3.0 | 610 | 301 | 6.0 | 400 |
| | C15 | | 800 | 3.0 | 610 | 350 | 6.0 | 400 |
| | C16 | | 800 | 3.0 | 610 | 500 | 6.0 | 400 |
| A40 | C17 | INVENTIVE EXAMPLE | 750 | 6.0 | 650 | 150 | 5.0 | 350 |
| | C18 | COMPARATIVE | 750 | 6.0 | 650 | 150 | 1.0 | 350 |

TABLE 7-continued

| STEEL No. | | EXAMPLE No. | 1st-ACCELERATED-COOLING COOLING START TEMPERATURE (° C.) | 1st-ACCELERATED-COOLING ACCELERATED-COOLING RATE (° C./sec) | 1st-ACCELERATED-COOLING ACCELERATED-COOLING STOPPAGE TEMPERATURE (° C.) | HOLDING HOLDING TIME (sec) | 2nd-ACCELERATED-COOLING ACCELERATED-COOLING RATE (° C./sec) | 2nd-ACCELERATED-COOLING ACCELERATED-COOLING STOPPAGE TEMPERATURE (° C.) |
|---|---|---|---|---|---|---|---|---|
| | C19 | EXAMPLE | 750 | 6.0 | 650 | 150 | 2.0 | 350 |
| | C20 | | 750 | 6.0 | 650 | 150 | 11.0 | 350* |
| | C21 | | 750 | 6.0 | 650 | 150 | 12.0 | 350* |
| A33 | C22 | INVENTIVE EXAMPLE | 720 | 5.0 | 620 | 35 | 5.0 | 400 |
| | C23 | COMPARATIVE | 720 | 5.0 | 620 | 35 | 5.0 | 520 |
| | C24 | EXAMPLE | 720 | 5.0 | 620 | 35 | 5.0 | 502 |
| | C25 | | 720 | 5.0 | 620 | 35 | 5.0 | 349 |
| | C26 | | 720 | 5.0 | 620 | 35 | 5.0 | 340 |

TABLE 8

| STEEL No. | | EXAMPLE No. | MICROSTRUCTURE OF HEAD PORTION 2 mm BELOW HEAD SURFACE | MICROSTRUCTURE OF HEAD PORTION 10 mm BELOW HEAD SURFACE | TOTAL AMOUNT OF PEARLITE AND BAINITE (area %) | HARDNESS OF HEAD PORTION 2 mm BELOW HEAD SURFACE | HARDNESS OF HEAD PORTION 10 mm BELOW HEAD SURFACE | RESULTS OF WEAR TEST WEAR AMOUNT (g) | RESULTS OF ROLLING CONTACT FATIGUE TEST NUMBER UNTIL FATIGUE DAMAGE IS GENERATED (TEN THOUSAND TIMES) |
|---|---|---|---|---|---|---|---|---|---|
| A36 | C1 | INVENTIVE EXAMPLE | P + B (25%) | P + B (25%) | 95 | 420 | 400 | 0.37 | — |
| | C2 | COMPARATIVE EXAMPLE | P + B (25%) | P + B (25%) | 95 | 390 | 360 | 0.55 | 110 |
| A15 | C3 | INVENTIVE EXAMPLE | P + B (25%) | P + B (20%) | 95 | 435 | 410 | 0.42 | — |
| | C4 | COMPARATIVE | P + B (25%) | P + B (20%) | 95 | 395 | 370 | 0.57 | 115 |
| | C5 | EXAMPLE | P + B (25%) | P + B (20%) | 95 | 360 | 320 | 0.59 | 75 |
| A38 | C6 | INVENTIVE EXAMPLE | P + B (35%) | P + B (25%) | 98 | 445 | 420 | 0.35 | — |
| | C7 | COMPARATIVE | P + B (35%) | P + B (25%) | 98 | 390 | 370 | 0.40 | 110 |
| | C8 | EXAMPLE | P + B (35%) | P + B (25%) | 98 | 395 | 370 | 0.39 | 115 |
| | C9 | | P +B (51%) | P +B (55%) | 98 | 415 | 375 | 0.70 | — |
| | C10 | | P +B (65%) | P +B (60%) | 98 | 420 | 380 | 0.75 | — |
| A21 | C11 | INVENTIVE EXAMPLE | P + B (40%) | P + B (35%) | 100 | 470 | 445 | 0.36 | — |
| | C12 | COMPARATIVE | P +B (60%) | P +B (55%) | 100 | 435 | 400 | 0.72 | — |
| | C13 | EXAMPLE | P +B (51%) | P +B (55%) | 100 | 425 | 400 | 0.70 | — |
| | C14 | | P +B (19%) | P +B (15%) | 100 | 440 | 420 | 0.35 | 85 |
| | C15 | | P +B (10%) | P +B (8%) | 100 | 465 | 445 | 0.35 | 50 |
| | C16 | | P +B (5%) | P +B (5%) | 100 | 490 | 465 | 0.28 | 40 |
| A40 | C17 | INVENTIVE EXAMPLE | P + B (49%) | P + B (45%) | 100 | 460 | 431 | 0.34 | — |
| | C18 | COMPARATIVE | P + B (49%) | P + B (45%) | 100 | 395 | 380 | 0.40 | 105 |
| | C19 | EXAMPLE | P + B (49%) | P + B (45%) | 100 | 399 | 380 | 0.41 | 110 |
| | C20 | | P + B (49%) | P + B (45%) | 100 | 385 | 365 | 0.45 | 85 |
| | C21 | | P + B (49%) | P + B (45%) | 100 | 360 | 340 | 0.51 | 75 |
| A33 | C22 | INVENTIVE EXAMPLE | P + B (48%) | P + B (45%) | 98 | 490 | 452 | 0.39 | — |
| | C23 | COMPARATIVE | P + B (48%) | P + B (45%) | 98 | 380 | 365 | 0.55 | 100 |
| | C24 | EXAMPLE | P + B (48%) | P + B (45%) | 98 | 395 | 370 | 0.53 | 110 |
| | C25 | | P +B (48%) +M | P +B (48%) +M | 94 | 501 | 480 | 1.40 | 100 |
| | C26 | | P +B (48%) +M | P +B (48%) +M | 80 | 535 | 495 | 2.35 | 60 |

BRIEF DESCRIPTION OF THE REFERENCE SYMBOLS

1: TOP HEAD PORTION

2: CORNER HEAD PORTION

3: RAIL HEAD PORTION

**3*a***: HEAD SURFACE PORTION (REGION FROM SURFACES OF CORNER HEAD PORTION AND TOP HEAD PORTION TO DEPTH OF 10 MM, SHADOW PORTION)

4: RAIL MATERIAL

5: WHEEL MATERIAL

6: AIR NOZZLE FOR COOLING

7: SLIDER FOR RAIL MOVEMENT
8: TEST RAIL
9: WHEEL
10: MOTOR
11: LOAD CONTROL DEVICE
12: SIDE HEAD PORTION

What is claimed is:

1. A rail comprising:

a rail head portion having a top head portion which is a flat region extending toward a top portion of the rail head portion in a extending direction of the rail, a side head portion which is a flat region extending toward a side portion of the rail head portion in the extending direction of the rail, and a corner head portion which is a region combining a rounded corner portion extending between the top head portion and the side head portion and an upper half of the side head portion, wherein the rail consists of as a chemical components, in terms of mass %:

C: 0.70% to 1.00%,
Si: 0.20% to 1.50%,
Mn: 0.20% to 1.00%,
Cr: 0.40% to 1.20%,
P: 0.0250% or less,
S: 0.0250% or less,
Mo: 0% to 0.50%,
Co: 0% to 1.00%,
Cu: 0% to 1.00%,
Ni: 0% to 1.00%,
V: 0% to 0.300%,
Nb: 0% to 0.0500%,
Mg: 0% to 0.0200%,
Ca: 0% to 0.0200%,
REM: 0% to 0.0500%,
B: 0% to 0.0050%,
Zr: 0% to 0.0200%,
N: 0% to 0.0200%, and
a remainder of Fe and impurities, wherein, in a region from a head surface constituted of a surface of the top head portion and a surface of the corner head portion to a depth of 10 mm, a total amount of pearlite structures and bainite structures is 95% by area or more, and an amount of the bainite structures is 20% by area or more and less than 50% by area, and wherein an average hardness of the region from the head surface to a depth of 10 mm is in a range of Hv 400 to Hv 500.

2. The rail according to claim 1, wherein the rail contains as the chemical components, in terms of mass %, one or more selected from the group consisting of:

Mo: 0.01% to 0.50%,
Co: 0.01% to 1.00%,
Cu: 0.05% to 1.00%,
Ni: 0.05% to 1.00%,
V: 0.005% to 0.300%,
Nb: 0.0010% to 0.0500%,
Mg: 0.0005% to 0.0200%,
Ca: 0.0005% to 0.0200%,
REM: 0.0005% to 0.0500%,
B: 0.0001% to 0.0050%,
Zr: 0.0001% to 0.0200%, and
N: 0.0060% to 0.0200%.

3. A production method for a rail, comprising:

hot-rolling a bloom or a slab containing the chemical components according to claim 2 in a rail shape to obtain a material rail, 1 st-accelerated-cooling the head surface of the material rail from a temperature region of 700° C. or higher which is a temperature region that is equal to or higher than a transformation start temperature from austenite to a temperature region of 600° C. to 650° C. at a cooling rate of 3.0° C./sec to 10.0° C./sec after the hot-rolling, holding a temperature of the head surface of the material rail in the temperature region of 600° C. to 650° C. for 10 sec to 300 sec after the 1st-accelerated-cooling, further, 2nd-accelerated-cooling the head surface of the material rail from the temperature region of 600° C. to 650° C. to a temperature region of 350° C. to 500° C. at a cooling rate of 3.0° C./sec to 10.0° C./sec after the holding, and naturally-cooling the head surface of the material rail to room temperature after the 2nd-accelerated-cooling.

4. The production method for a rail according to claim 3, further comprising:

preliminarily-cooling the hot-rolled rail and then reheating the head surface of the material rail to an austenite transformation completion temperature+30° C. or higher between the hot-rolling and the 1st-accelerated-cooling.

5. A production method for a rail, comprising:

hot-rolling a bloom or a slab containing the chemical components according to claim 1 in a rail shape to obtain a material rail, 1 st-accelerated-cooling the head surface of the material rail from a temperature region of 700° C. or higher which is a temperature region that is equal to or higher than a transformation start temperature from austenite to a temperature region of 600° C. to 650° C. at a cooling rate of 3.0° C./sec to 10.0° C./sec after the hot-rolling, holding a temperature of the head surface of the material rail in the temperature region of 600° C. to 650° C. for 10 sec to 300 sec after the 1st-accelerated-cooling, further, 2nd-accelerated-cooling the head surface of the material rail from the temperature region of 600° C. to 650° C. to a temperature region of 350° C. to 500° C. at a cooling rate of 3.0° C./sec to 10.0° C./sec after the holding, and naturally-cooling the head surface of the material rail to room temperature after the 2nd-accelerated-cooling.

6. The production method for a rail according to claim 5, further comprising:

preliminarily-cooling the hot-rolled rail and then reheating the head surface of the material rail to an austenite transformation completion temperature+30° C. or higher between the hot-rolling and the 1 st-accelerated-cooling.

* * * * *